US005237979A

United States Patent [19]

Hyodo et al.

[11] Patent Number: 5,237,979

[45] Date of Patent: Aug. 24, 1993

[54] EVAPORATIVE FUEL CONTROL APPARATUS OF INTERNAL COMBUSTION ENGINE

[75] Inventors: Yoshihiko Hyodo, Susono; Takaaki Itou, Mishima; Akinori Osanai; Toru Kidokoro, both of Susono, all of Japan

[73] Assignee: Toyota Jidosha Kabushiki Kaisha, Toyota, Japan

[21] Appl. No.: 931,626

[22] Filed: Aug. 18, 1992

[30] Foreign Application Priority Data

| | | | |
|---|---|---|---|
| Sep. 2, 1991 | [JP] | Japan | 3-221816 |
| Sep. 26, 1991 | [JP] | Japan | 3-247593 |
| Mar. 5, 1992 | [JP] | Japan | 4-48890 |

[51] Int. Cl.[5] ..... F02M 33/02

[52] U.S. Cl. ..... 123/520; 123/516

[58] Field of Search ..... 123/520, 519, 518, 516, 123/381, 521

[56] References Cited

U.S. PATENT DOCUMENTS

| | | | |
|---|---|---|---|
| 4,664,087 | 5/1987 | Hamburg | 123/520 |
| 4,962,744 | 10/1990 | Uranishi | 123/519 |
| 5,146,402 | 9/1992 | Cook | 123/518 |
| 5,158,059 | 10/1992 | Kuroda | 123/520 |
| 5,186,153 | 2/1993 | Steinbrenner | 123/519 |

FOREIGN PATENT DOCUMENTS

| | | | |
|---|---|---|---|
| 128960 | 8/1985 | Japan . | |
| 135625 | 6/1987 | Japan . | |
| 289243 | 11/1988 | Japan . | |
| 0125552 | 5/1989 | Japan | 123/519 |
| 134767 | 9/1989 | Japan . | |
| 249367 | 11/1991 | Japan . | |

*Primary Examiner*—Carl S. Miller

*Attorney, Agent, or Firm*—Kenyon & Kenyon

[57] ABSTRACT

An evaporative fuel control system able to control an air-fuel ratio of an engine to be a stoichiometric air-fuel ratio while a purge of evaporative fuel is executed The system comprises a microcomputer for computing a target flow amount of evaporative fuel gas to be purged into an intake line via a solenoid valve in accordance with signals from a volume detecting sensor, a fuel temperature detecting sensor, and an air flow detecting sensor; the micro computer also serving for computing a fuel vapor amount contained in the target flow amount. An air flow amount contained in the target flow amount of evaporative fuel gas purged into the intake line is computed by the microcomputer in accordance with the fuel vapor amount therein. A correction amount of fuel to be injected into the intake line is controlled so as to obtain a stoichiometric air-fuel ratio in various conditions of the engine.

12 Claims, 25 Drawing Sheets

FUEL TANK
1
4
EVAPORATIVE FUEL GAS AMOUNT COMPUTING MEANS
11
FUEL VAPOR AMOUNT COMPUTING MEANS
12
6
2
AIR AMOUNT COMPUTING MEANS
13
14
5
FUEL INJECTION AMOUNT COMPUTING MEANS
7
3
INTERNAL COMBUSTION CHAMBER

FUEL TANK
REQUIRED FUEL INJECTION AMOUNT
ACTUAL FUEL INJECTION AMOUNT
DEFLECTION AMOUNT COMPUTING MEANS
CORRECTION AMOUNT COMPUTING MEANS
CORRECTION FACTOR COMPUTING MEANS
FUEL VAPOR AMOUNT COMPUTING MEANS
FUEL CORRECTION AMOUNT COMPUTING MEANS
INTERNAL COMBUSTION ENGINE
1
2
3
4
5
6
7
17
18
19
51
52
53

EVAPORATIVE FUEL CONTROL APPARATUS OF INTERNAL COMBUSTION ENGINE

BACKGROUND OF THE INVENTION (1) Field of the Invention

The present invention generally relates to an evaporative fuel control apparatus, and more particularly to an evaporative fuel control apparatus of an internal combustion engine for feeding fuel vapor from a fuel tank to an intake system through a purge passage in order to introduce fuel vapor into a combustion chamber.

(2) Description of the Related Art

Conventionally, an evaporative fuel control apparatus is known in which evaporative fuel gas generated in a fuel tank is directly fed to an intake system through a purge passage, which passage directly connects the fuel tank and an intake pipe of an engine, in order to burn fuel vapor in a combustion chamber. Further, an evaporative fuel control apparatus is suggested in Japanese Laid-Open Patent Application No. 62-135625, which includes detecting means for detecting an amount of evaporative fuel gas and controling means for decreasing an amount of fuel injected by a fuel injection valve in response to a detected amount of evaporative fuel gas. This evaporative fuel control apparatus detects an amount of evaporative fuel gas based on an interrelation between temperatures of cooling water, intake air, and fuel. A correction factor, for decreasing an amount of injected fuel at start-up of an engine, is calculated from the amount of detected fuel vapor. This is because when starting an engine, an air-fuel ratio is extremely fuel rich resulting in undesired conditions at start-up of the engine. The control apparatus is comprised so as to appropriately control, by means of a correction factor, an amount of injected fuel at start-up of the engine, thus realizing a good start of the engine.

In the above mentioned conventional evaporative fuel control system, the coefficient of correction for decreasing an amount of injected fuel at start-up of an engine, calculated from the amount of fuel vapor, is simply calculated on the basis of an interrelation between temperature of cooling water, intake air, and fuel. Generally, evaporative fuel gas generated in a fuel tank comprises a mixture of pure fuel (gasoline) vapor and air in the fuel tank. Increased fuel vapor in the evaporative fuel gas makes an air-fuel ratio in the rich side, on the other hand, the air in evaporative fuel gas makes an air-fuel ratio in lean side. Accordingly, an increase of air in evaporative fuel gas requires that an amount of fuel to be injected is increased, which is contrary to the correction required by the correction factor mentioned above.

The correction of an amount of fuel in the above mentioned apparatus is mainly for the starting time of an engine. Changes in temperature conditions while the engine is running are not considered. Additionally, a volume of empty space inside a fuel tank is one of the factors increasing and decreasing generated fuel vapor while engine is running. Therefore, accurate controling of the mixture can not be performed with the conventional apparatus, because the conventional apparatus does not take into account the effect of the amount of air in evaporative fuel gas.

SUMMARY OF THE INVENTION

It is a general object of the present invention to provide an improved evaporative fuel control apparatus in which the above mentioned disadvantages are eliminated.

A more specific object of the present invention is to provide an evaporative fuel control apparatus in which an air-fuel ratio is appropriately controlled in all conditions of operation of an engine, by accurately correcting the amount of fuel to be injected.

In order to achieve the above mentioned object, an evaporative fuel control system for an internal combustion engine of the present invention comprises:

an evaporative fuel supplying system comprising a fuel tank, a purge passage connecting an intake line of the engine and the fuel tank;

a volume detecting means, for detecting a volume of space, of said fuel tank, filled with evaporative fuel gas;

temperature detecting means, for detecting a temperature of fuel in said fuel tank;

flow detecting means, for detecting an amount of air suctioned into the intake line and flowing therein;

a net fuel vapor amount computing means, for computing a first target flow amount of evaporative fuel gas to be purged into the intake line in accordance with signals from the volume detecting means, the temperature detecting means, and the flow detecting means, and for computing a fuel vapor amount contained in the first target flow amount;

a fuel correction amount computing means, for computing an air flow amount contained in the first target flow amount of evaporative fuel gas purged into the intake line in accordance with a fuel vapor amount computed by the net fuel vapor amount computing means, and for computing a correction amount of fuel to be injected into the intake line so as to obtain a stoichiometric air-fuel ratio in various conditions of the engine.

According to the present invention, the amount of injected fuel is appropriately corrected by computing a net amount of fuel vapor and air contained in evaporative fuel gas even though a ratio of fuel vapor to air in the evaporative fuel gas is changed, and thus an optimum control of the air-fuel ratio is realized under any conditions of the engine.

Other objects, features and advantages of the present invention will become more apparent from the following detailed description when read in conjunction with the accompanying drawings.

DESCRIPTION OF THE PREFERRED EMBODIMENTS

Figure 1:
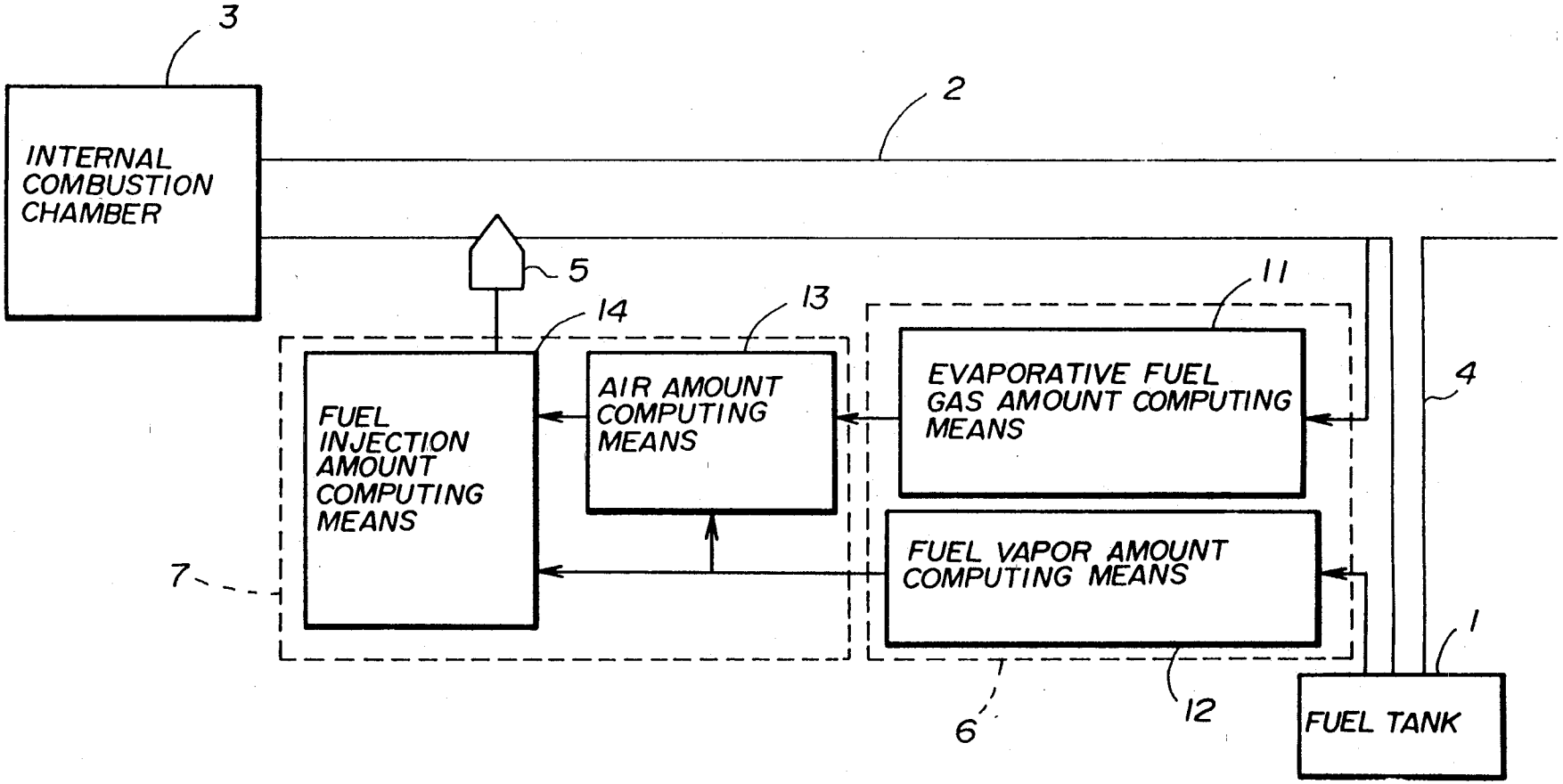
FIG. 1 is a schematic block diagram for explaining a system of a first embodiment of the present invention.

A description will be given of a first embodiment of the present invention with reference to FIG. 1. FIG. 1 is a schematic block diagram for explaining a system of a first embodiment of the present invention.

A fuel tank 1 and an intake passage 2 of an internal combustion engine 3 are directly connected by a connecting passage 4. Evaporative fuel gas that is a mixture of air and fuel vapor is purged to the intake passage 2 while the engine 3 is running so that the evaporative fuel generated in the fuel tank 1 is disposed. A fuel injection valve 5 is provided to supply an amount of fuel to the intake passage 2 so as to operate the engine 3.

Means 6 for computing a net amount of fuel vapor purged to the intake passage 2, is provided so as to supply data concerning the net amount of fuel vapor purged to the intake passage 2; means 7, for computing a correction amount of fuel to be injected from the fuel injection valve 5 are also provided. The means 6 computes a net amount of fuel vapor in the evaporative fuel gas based on data supplied from sensors, which sensors are provided in the fuel tank 1, and the intake passage 2. The means 7 computes an amount of air contained in the purged evaporative fuel gas, and determines the correction amount of fuel to be injected by the fuel injection valve 5, based on the difference between the purged gas airfuel mixture ratio and the air-fuel ratio required by the engine 3.

As shown in FIG. 1, the computing means 6 for computing a net amount of purged fuel vapor includes detecting means 11 for detecting an amount of generated evaporative fuel gas and detecting means 12 for detecting an amount of fuel vapor in the fuel gas. The detecting means 11 computes an amount of evaporative fuel gas purged to the intake passage 2 while the engine 3 is running. The computation is performed based on signals received from a sensors provided to the fuel tank 1 and the intake passage2 and based on a predetermined map. The detecting means 12 computes an amount of fuel vapor contained in amount of evaporative fuel gas as computed by the means 11. This computation is also performed based on signals taken from a sensor provided to the fuel tank 1 and based on a predetermined map.

The computing means 7 of FIG. 1 comprises computing means 13 for computing an amount of air contained in the evaporative fuel gas, and computing means 14 for computing a correction amount of fuel to be injected by the fuel injection valve 5. The means 14 computes the correction amount of fuel based on the amount of fuel vapor in the fuel gas as computed by the detecting means 12 and the amount of air in the fuel gas as computed by the computing means 13, so that air-fuel ratio of fuel mixture suctioned into the engine has the desired value.

Figure 2:
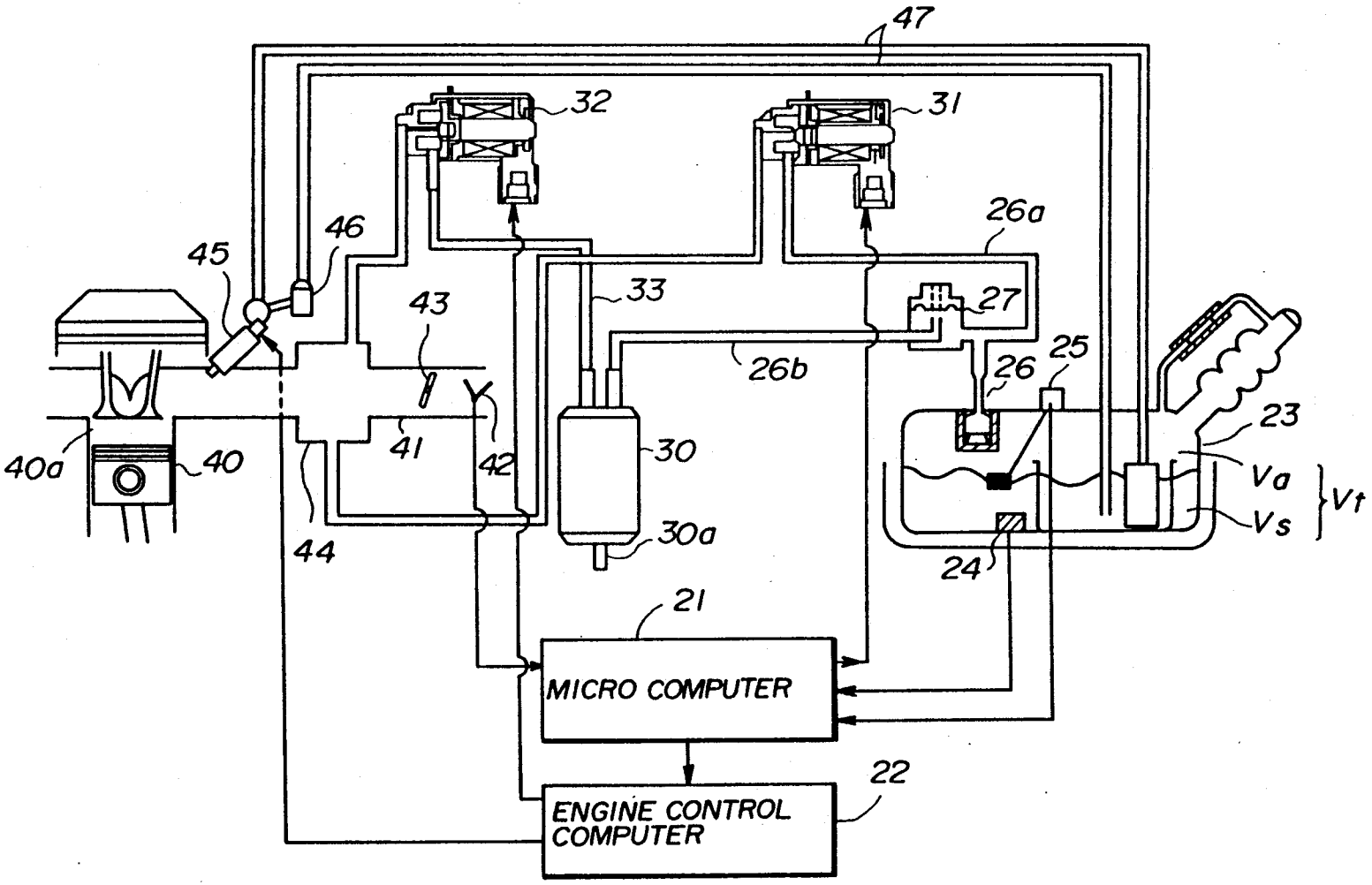
FIG. 2 is a schematic illustration of a system construction of the first embodiment of the present invention.

FIG. 2 is a schematic illustration of a system construction of the first embodiment of the present invention. A 4-stroke spark-ignition type internal combustion engine 40 controlled by a microcomputer 21 and an engine control computer (ECU) 21, is used as the internal combustion engine 3 of FIG. 2.

In a fuel tank 23, there is provided a fuel temperature sensor 24, and a fuel level sensor 25 used for measuring a fuel amount remaining in the fuel tank 23. Signals from the sensors 24 and 25 are supplied to the microcomputer 21.

Reference numeral 41 indicates an intake pipe corresponding to the intake passage 2 of FIG. 2, which intake pipe is connected to the engine 40. On the intake pipe 41, there is provided an air flow sensor 42, a throttle valve 43, a surge tank 44, and a fuel injection valve 45. The air flow sensor 42 detects an amount of air flowing inside the intake pipe 41 so as to supply a detected signal to the micro computer 21. The throttle valve 43 is connected to an acceleration pedal not shown in the figure. The surge tank 44 is provided for suppressing a pulsation of suction air flowing in the intake pipe 41.

Provided between the fuel injection valve 45 and the fuel tank 23, there are fuel circulation tubes 47, for allowing fuel in the fuel tank 23 to be circulated by a circulation pump 46. An amount of fuel is injected into the intake pipe 41 by the fuel injection valve 45 when the valve is open in accordance with a command from the microcomputer 21. The amount of fuel injected by the valve 45 is proportional to the time the valve 45 is open.

A vapor line 26 connects the fuel tank 23 and a control valve controling a pressure inside the fuel tank 23. A direct line 26a, corresponding to the connection passage 4 of FIG. 2, connects the control valve 27 and the surge tank 44 of the intake pipe, via a vacuum switching valve (VSV) 31, which valve is a solenoid valve. A canister line 26b connects the control valve 27 and a canister 30. The canister 30 contains an adsorbent such as activated carbon and comprises an atmospheric pressure introducing port 30a, which is provided in the lower portion thereof. A purge line 33 is provided, which connects the canister 30 and the surge tank 44 via another solenoid valve 32. The control valve 27 controls evaporative fuel gas not flowing into the canister 30 from the fuel tank 23 while the engine is running. The solenoid valve 31 controls an amount of evaporative fuel gas flowing from the fuel tank 23 to the surge tank 44 of the intake pipe 41, by adjusting a valve opening in response to a signal supplied from the microcomputer 21. The solenoid valve 31 also controls an application of a negative pressure from inside the intake pipe 41 to the fuel tank 23, so as to prevent a generation of additional evaporative fuel gas in the fuel tank 23. Through the direct line 26a and the purge line 33, both directing flow of the evaporative fuel from the fuel tank 23, are connected to the surge tank 44, they can be connected to another portion, along the intake pipe fort example.

As is known, evaporative fuel generated in the fuel tank 23 while the engine is stopped is adsorbed by the activated carbon in the canister 30 by passing through the canister line 33, thus, releasing of evaporative fuel gas to the atmosphere is prevented. The evaporative fuel in the canister 30 is separated from the adsorbent by air introduced from the port 30a of the canister 30; this operation is performed by utilizing a negative pressure in the surge tank 44 generated in an idle time after the starting of the engine. At this moment, the solenoid valve 32 is open; the evaporative fuel is suctioned into the intake pipe 41 by passing through the purge line 33 and is then led to the combustion chamber 40a for combustion.

While the engine is continuously running, the temperature of fuel circulating between the fuel tank and the fuel injection valve 45, through a fuel circulation line 47, is raised because the temperature of the valve 45 becomes high due to a heat from the engine. The evaporative fuel generated in the fuel tank 23 due to the temperature rise of the fuel is suctioned through the direct line 26a into the intake pipe 41 by utilizing a negative pressure inside the surge tank 44 when the solenoid valve is appropriately opened.

Figure 3:
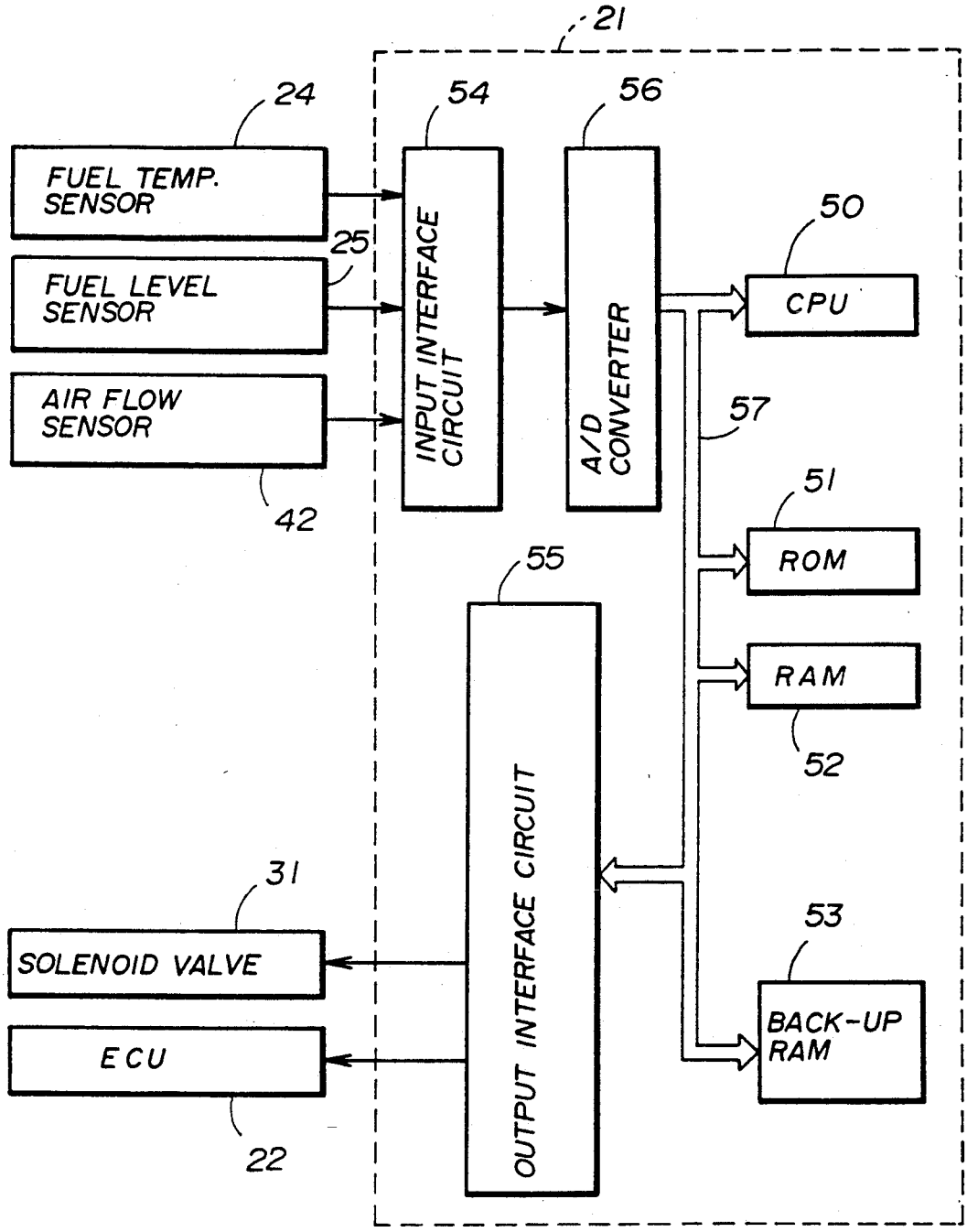
FIG. 3 is a block diagram of the micro computer 21 shown in FIG. 2.

The microcomputer 21 controlling the above mentioned component parts comprises hardware shown in FIG. 3. In FIG. 3, those parts that are the same as corresponding parts in FIG. 2 are designated by the same reference numerals, and descriptions thereof will be omitted.

As shown in FIG. 3, a microcomputer 21 comprises a central processing unit (CPU) 50, a read only memory (ROM) 51, a random access memory (RAM) 52, another RAM 53, an input interface circuit 54, an A/D converter 56 with multiplexer, and an output interface circuit 55, all these connected by a bus 57. The ROM 51 is for storing process programs, the RAM 52 for use as working area, and the RAM 53 for backing up a data after the engine is stopped.

The A/D converter 56 periodically obtains signals concerning fuel temperature, from a fuel temperature sensor 24, remaining fuel, from a fuel level sensor 25, and suction air amount from an air flow sensor 42, by switching in turn, and converting them to digital data and sends the data to the bus 57. Signals processed by the CPU 50 are supplied to the output interface 55 via the bus 57 to control the solenoid valve 31 and the ECU 22. The ECU 22 controls the operation of the fuel injection valve 45 and the solenoid valve 32 in response to the signals supplied from the microcomputer 21. The opening of the solenoid valve 32 is controlled in response to the suctioned air by the engine in an idling time after the engine is started. The control of the valve 45 will be explained in the following.

Figure 4:
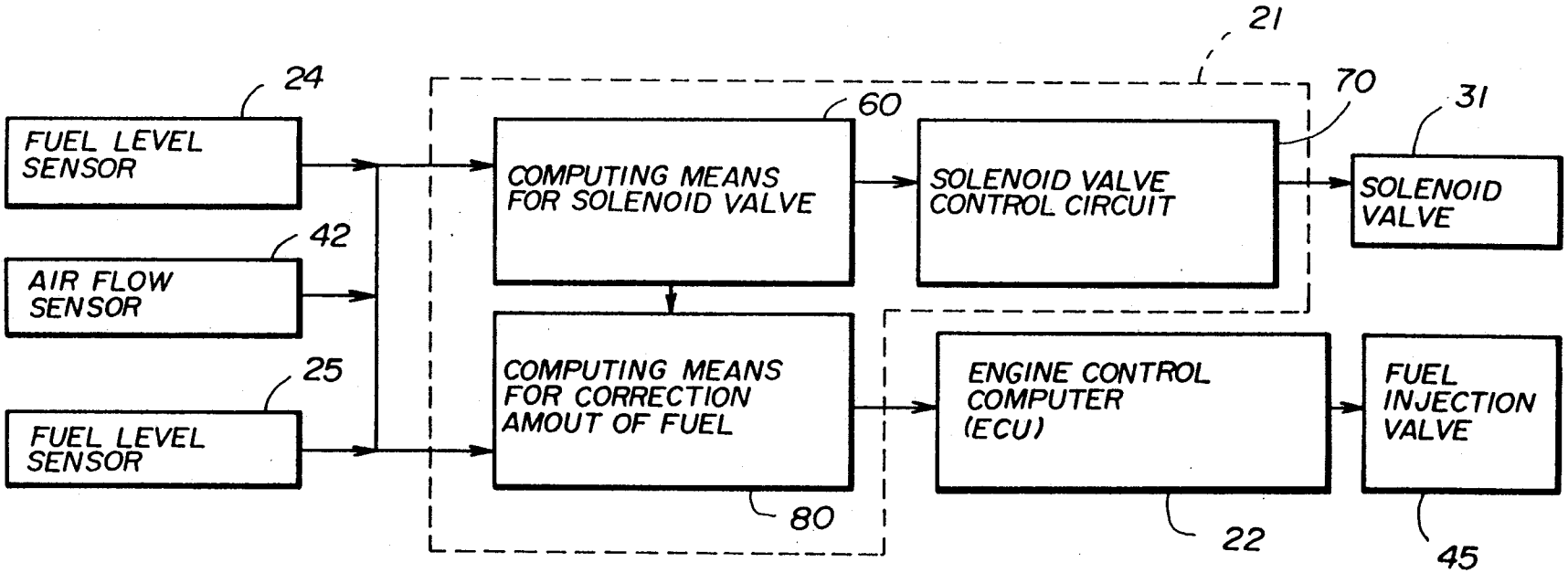
FIG. 4 is a block diagram of a process performed by a micro computer 21 of FIG. 3.

FIG. 4 is a block diagram of a process performed by a microcomputer 21 of FIG. 4. The microcomputer 21 includes means 60 for computing a flow amount of the solenoid valve 31, means 70 for controling the solenoid valve, and means 80 for computing a correction amount of the fuel. The amount of evaporative fuel gas is computed by the means 60, and a degree of an opening of the valve 31 is determined thereby. The data of the determined degree of valve opening is then sent to the means 70 for controling the solenoid valve 31, so as to allow a target amount of evaporative fuel to flow through the solenoid valve 31. On the other hand, the means 80 for computing a correction amount of fuel computes the net amount of fuel vapor flowing into the intake pipe 41 so as to correct the time during which the fuel injection valve 45 is open, as computed by the ECU 21.

The CPU 50 realizes the above mentioned means 6 for computing a net amount of fuel vapor, and the means 7 for computing an amount of air included in the purged evaporative fuel gas in accordance with the stored programs therein.

A description will now be given, with reference to a flow chart of FIG. 6, of a process of computing the target amount of flow for the solenoid valve 31. The target amount of flow is determined to be a generated amount of evaporative fuel gas including the evaporative fuel gas generated due to a temperature rise of the fuel.

By means of such a determination, all of the net amount of the fuel vapor can be purged to the intake pipe 41, and additional generation of evaporative fuel gas, caused by a negative pressure generated inside the intake pipe 41, is prevented.

Figure 6:
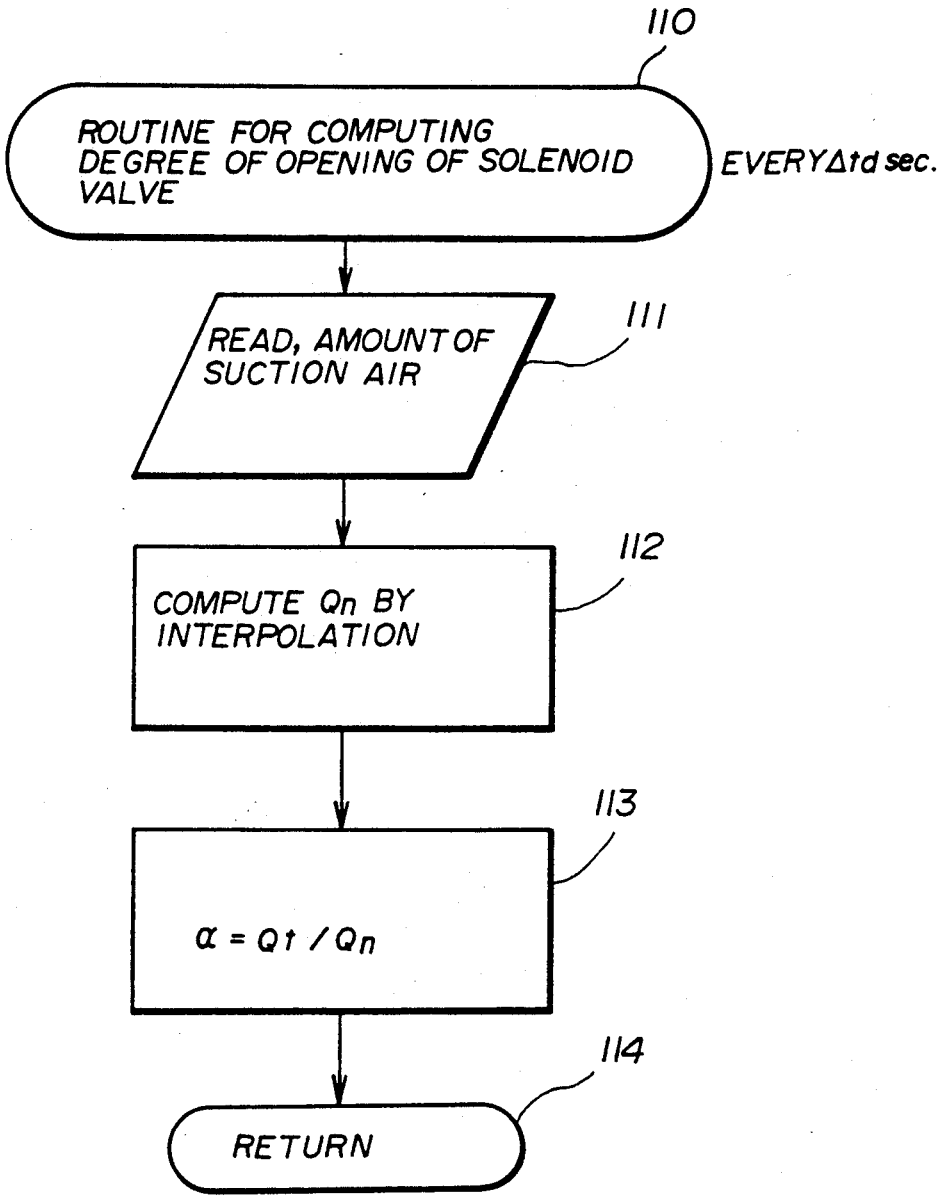
FIG. 6 is a flow chart of a routine 110 for determining the degree of opening of the solenoid valve 31.
Figure 9:
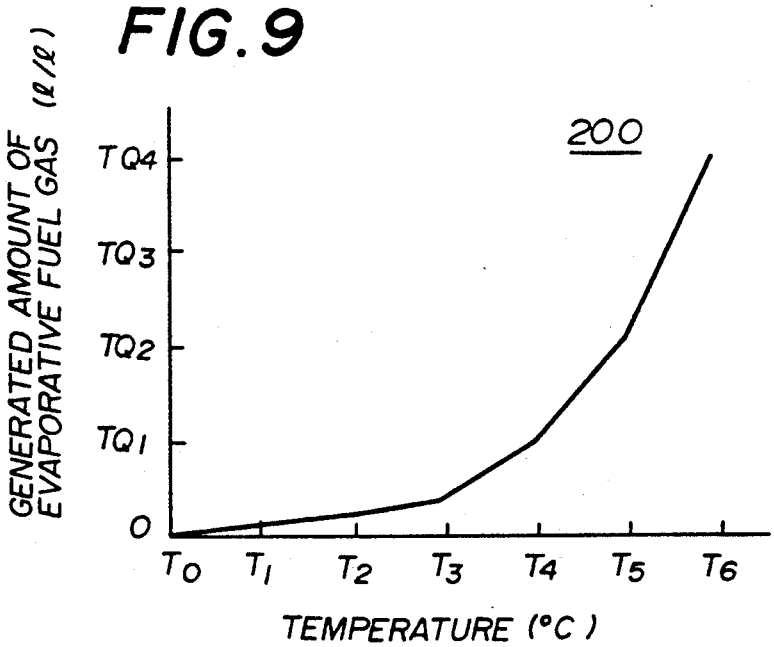
FIG. 9 is a graph showing a relationship between fuel temperature and generated amount of evaporative fuel gas per one litter of space in a fuel tank.
Figure 10:
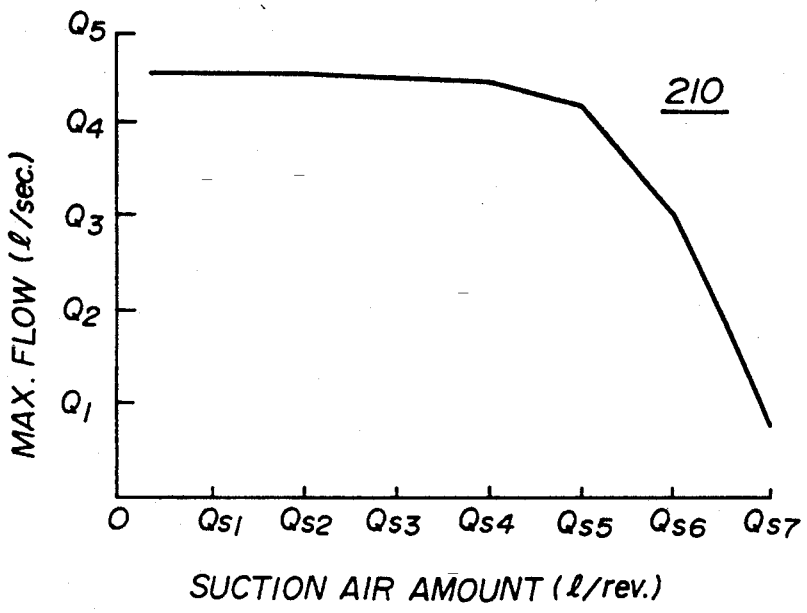
FIG. 10 is a graph showing a relationship between air suction and maximum flow of the solenoid valve.
Figure 11:
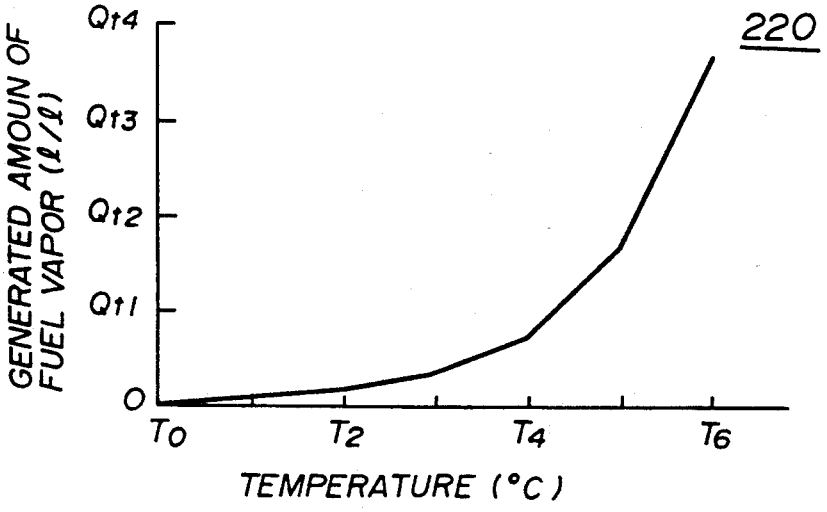
FIG. 11 is a graph showing a relationship between fuel temperature and generated fuel vapor per one liter of space in a fuel tank.

A routine 100 of FIG. 6 is a flow chart of the process for computing the target amount of flow. The routine 100 interruptedly starts every $\Delta$ tc seconds. When the routine 100 starts every$\Delta$ tc seconds, first in step 101, the CPU 50 reads the fuel temperature data Tn, which data is received from the fuel temperature sensor 24 and stored in the RAM 52. Next, in step 102, the amount of evaporative fuel generated at the fuel temperature of Tn is computed in accordance with a map 200 of generated amounts of evaporative fuel gas, the map 200 is shown in FIG. 9. The map 200 is a relationship, obtained by experiment, between fuel temperature T and the amount of generated evaporative fuel gas Qt generated by 1 liter of volume in the fuel tank 23 from the temperature of −20° C. to T° C. Accordingly the unit of TN is liter/liter.

In step 103, An amount of evaporative fuel gas QL generated during the rise in fuel temperature, from the temperature $T_0$ at previous execution of the routine to the temperature Tn at the present time, is obtained. The amount QL is calculated by subtracting $TQ_0$ from TQn, where $TQ_0$ is the stored amount of evaporative fuel gas at previous execution of the routine, and the TQn is the amount of evaporative fuel gas at the present time. That is, QL is calculated by equation $QL = TQn - TQ_0$.

Next, in step 104, a volume Va of an empty space of the fuel tank 23 is calculated by subtracting Vs, which is a volume obtained in accordance with a signal from the fuel level sensor 25, from the entire volume Vt of the fuel tank 23. The amount QL calculated in the step 103 is the amount of evaporative fuel gas generated by 1 liter of the volume Va of an empty space of the fuel tank 23 while the fuel temperature rises from $T_0$ to Tn. Accordingly, in step 105, the target flow amount of Qt (liter/sec), at the present time is calculated as per an equation $QT = QL \times Va/\Delta tc$.

Next, in step 106, $TQ_0$ is substituted by TQn for the next execution. The revised $TQ_0$ and the target amount of flow Qt are stored in the RAM 52, in step 107, and the routine 100 ends in step 108.

It is to be noted that although the amount QL of evaporative fuel gas generated during the rise in temperature of the fuel, from the temperature T° at previous execution of the routine to the temperature Tn at the present time, is obtained by the map 200, referred in step 102, the QL can be calculated by the following equation (1).

$$QL = \frac{R \cdot Tn}{Pa - Pg(Tn)} \quad \frac{Pa - Pg(T_0)}{RT_0} - \frac{Pa - Pg(Tn)}{RTn} \quad (1)$$

Where:

R is a gas constant,

Pa is pressure in the fuel tank 23 ( nearly equal to the atmospheric pressure), and Pg(T) is a vapor pressure of the evaporative fuel at the fuel temperature T.

The vapor pressure of the evaporative fuel can be calculated as per the following equation (2).

$$\mathrm{Log}_{10}Pg(Tc) = 6.07918 - 3.19837 \times \frac{232 + Tb}{112 - Tb} \times \frac{1120 - Tc}{232 + Tc} \quad (2)$$

Where:

Tb is boiling point temperature (55° C.), and

Tc is the fuel temperature.

Figure 7:
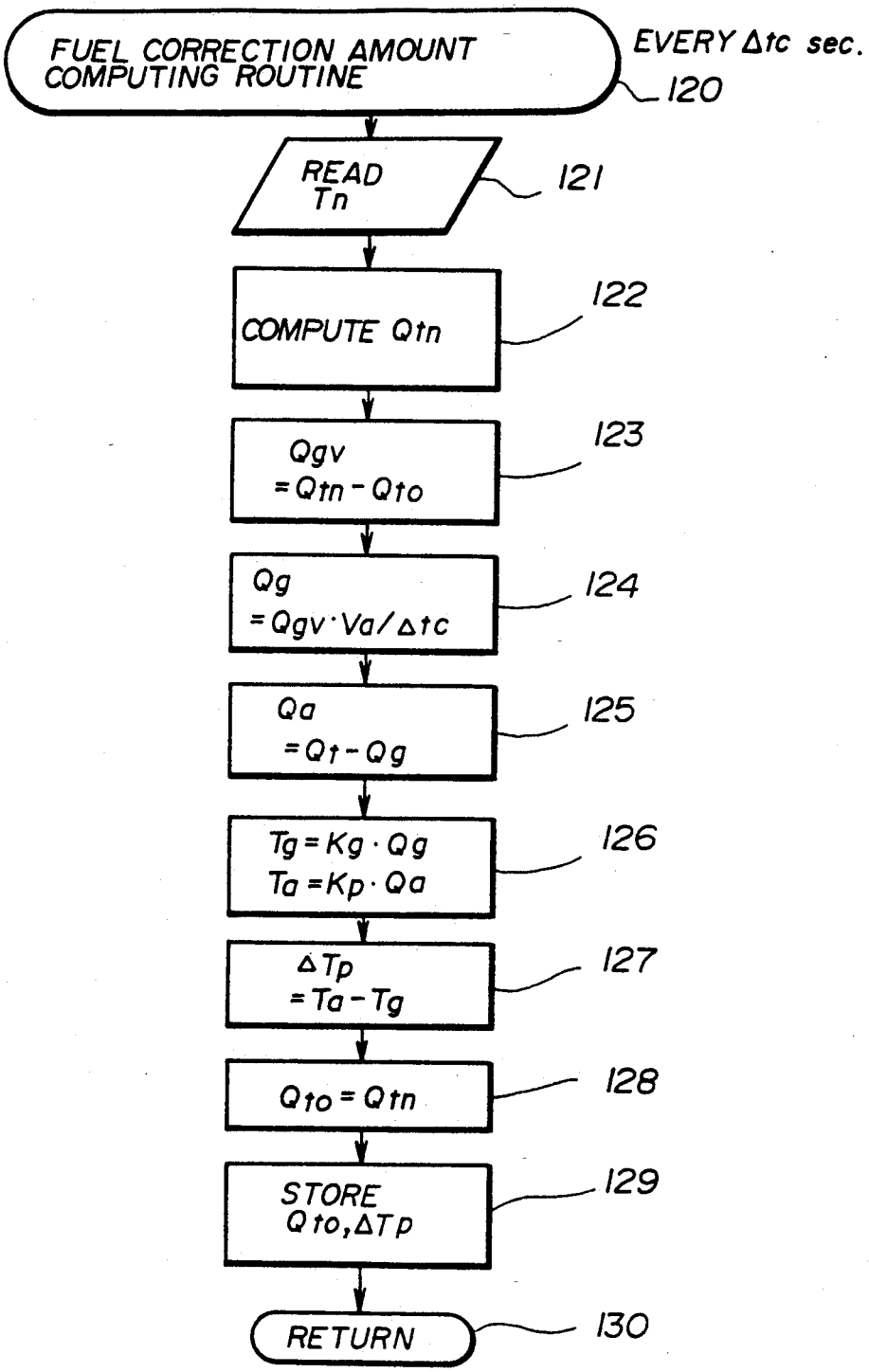
FIG. 7 is a flow chart of a routine 120 for the correction of fuel to be injected from the fuel injection valve 45.

FIG. 7 is a routine 110 for determining the degree of opening of the solenoid valve 31. The routine 110 is executed every Δ Td seconds, similarly to the above mentioned routine 100, by the means 60 of FIG. 4. First, in step 111, the CPU 50 reads the air flow data (liters/-rev.), which data is received from the flow sensor 42 and stored in the RAM 52. Next, in step 112, the amount of flow of evaporative fuel gas Qn (max. flow) flowing through the solenoid valve 31 is computed in accordance with a map 210 shown in FIG. 9. The map 210 is a relationship, obtained by experiment, between the amount of air flow in the intake pipe and the amount of flow of evaporative fuel gas through the solenoid valve 31 when the valve 31 is fully opened.

Figure 5:
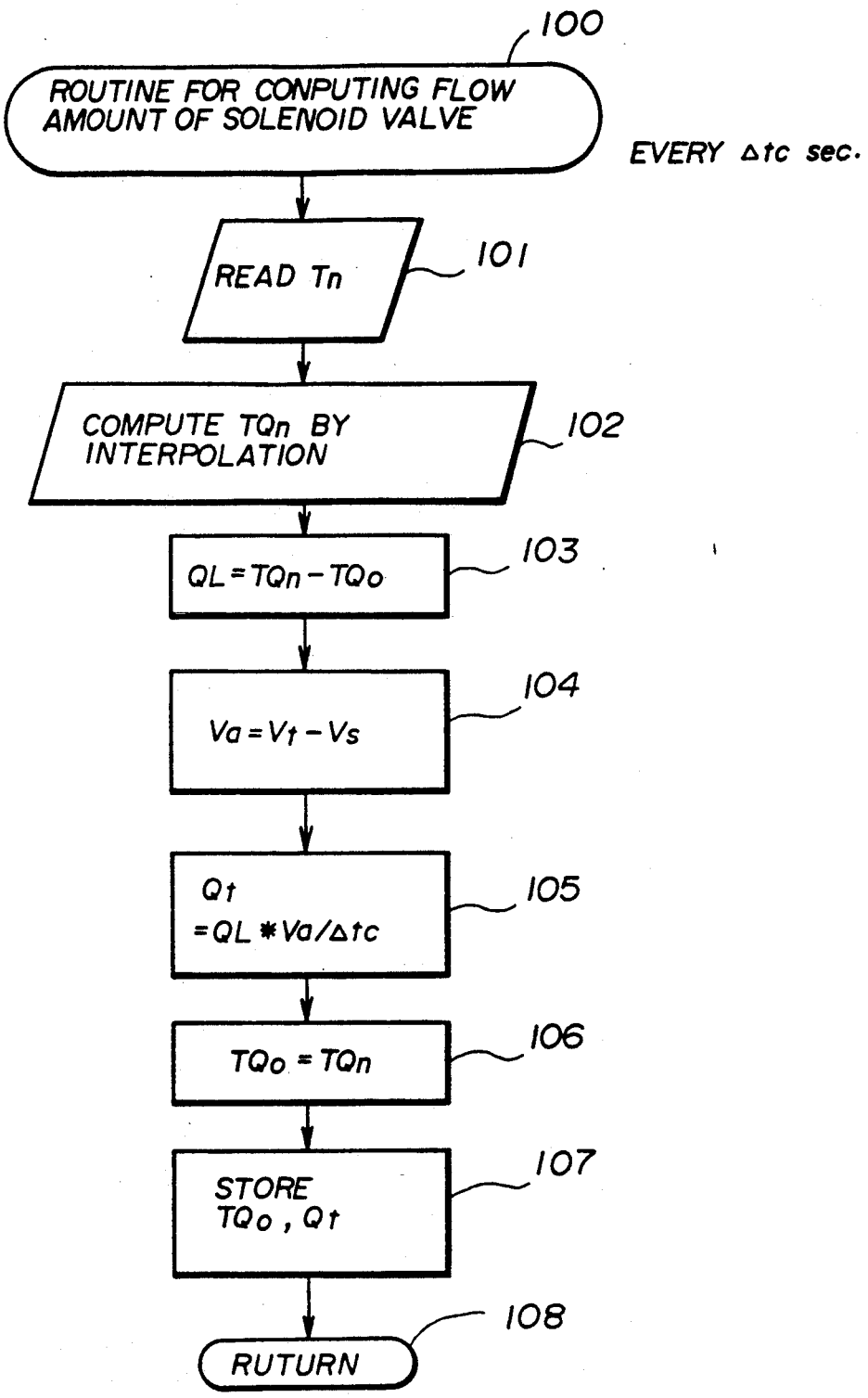
FIG. 5 is a flow chart of a routine for computing the target amount of flow.

Next, in step 113, a degree $\alpha$ of opening of the valve 31 is determined in accordance with the proportion of Qn and Qt obtained in the routine 100. Next, the routine 110 ends. Data concerning the degree$\alpha$ of opening of the valve 31 is supplied to the means 70 of FIG. 5 for operating the valve 31. The degree of opening of the valve 31 is controlled by the duration of time the valve is opened. In other words, the valve is driven by an electric pulse signal, and the duration of opening time of the valve 31 is determined by the total time of the each supplied pulses. This control method of the valve permits obtaining a good accuracy of the amount of the evaporative fuel flow at the valve 31.

Next, a description will be given, with reference to a flow chart shown in FIG. 7, of a process for correction of fuel amount to be injected. The idea of the correction of the fuel to be injected is that computing the net amount of fuel vapor and the amount of air contained in the evaporative fuel gas in the fuel tank 23; decreasing the amount of fuel to be injected from the fuel injection valve 45 when an actual air-fuel ratio is in the rich side of the stoichiometric air-fuel ratio; increasing the amount of fuel to be injected when the actual ratio is in the lean side of the stoichiometric ratio.

FIG. 7 is a flow chart of a routine 120 for the correction of the fuel amount to be injected by the fuel injection valve 45. The routine 120 is executed every Δ Tc seconds, similarly to the above mentioned routine 100, by the means 80 of FIG. 5. First, in step 121, the CPU 50 reads the fuel temperature data Tn, which data is received from the temperature sensor 24 and stored in the RAM 52. Next, in step 122, the net amount of the fuel vapor Qtn is computed in accordance with a map 220 shown in FIG. 12.

The map 220 is a relationship, obtained by experiment, between the fuel temperature T and the integrated amount of generated fuel vapor Qt generated by 1 liter of volume in the fuel tank 23 at temperatures from −20° C. to T° C.

Next, the amount of fuel vapor Qgv, generated when the fuel temperature raised from $T_0$ to Tn, is obtained in step 123. The amount of evaporative fuel gas Qgv can be represented by the difference between the amount of generated fuel vapor of the last time $Qt_0$ and Qtn of the present time. In other words, the amount of fuel vapor Qgv can be calculated as per the equation $Qgv = Qtn - Qt_0$.

The amount of fuel vapor Qgv is an integrated amount of fuel vapor generated by 1 liter of volume in the fuel tank 23 at temperatures from $T_0$ to Tn. Accordingly, in the step 124, the amount of fuel vapor Qg (liters/sec) of the present time is calculated as per the equation $Qg = Qgv \times Va/\Delta tc$.

In step 125, the amount of air contained in the evaporative fuel gas is calculated by subtracting the amount of fuel vapor Qgv from the target amount of evaporative fuel gas flow Qt of the routine 100. In step 126, converted values for the fuel injection amount Tg and Ta are calculated by respectively multiplying factors Kg and Kp. The factor Kg is for converting the amount of fuel expressed in liters, purged from the solenoid valve 31, to the amount of fuel to be injected from the fuel injection valve 45 (duration of injection time). The factor Kp is for converting the amount of air contained in the evaporative fuel gas purged from the solenoid valve 31 to the amount of fuel to be injected from the fuel injection valve 45 (duration of injection time).

Next, in step 127, a correction value Δ Tp of the amount of fuel injection is calculated by subtracting the Tg from the Ta. If Ta>Tg, that is Δ Tp is a positive number, the mixing ratio of the amount of fuel vapor and air in the evaporative fuel gas is in the rich side of the stoichiometric air-fuel ratio. If Ta<Tg, that is Δ Tp is a negative number, the mixing ratio of the amount of fuel vapor and air in the evaporative fuel gas is in the lean side of the stoichiometric air-fuel ratio. When the evaporative fuel gas purged from the solenoid valve has the same air-fuel ratio as the stoichiometric air-fuel ratio, Ta is equal to Tg, that is Δ Tp=0.

In step 128, in preparation for the next execution, $Qt_0$ is substituted by the amount of the generated evaporative fuel Qtn at the present time. In step 129, the revised $Qt_0$ and Δ Tp obtained in the step 127 are stored in the RAM 52, and the routine 120 ends in step 130.

As mentioned above, by execution of the routine 120, the amount of air Qa in the evaporative fuel gas is computed from the net amount of the fuel vapor and the amount of the evaporative fuel gas, and thus the correction value Δ Tp for correcting the air-fuel ratio so as to match the stoichiometric ratio can be obtained.

It is to be noted that, although the amount of fuel vapor Qgv, generated when the fuel temperature is raised from $T_0$ to Tn, is obtained by the map 220, used in step 122, Qgv can be calculated as per the following equation (3):

$$Qgv = \frac{Pg(Tn)}{Pa} \times QL \quad (3)$$

where:

Pa is a pressure inside the fuel tank 23;

Pg(Tn) is a vapor pressure of the evaporative fuel at the fuel temperature of Tn(° K); and QL is an integrated amount of the evaporative fuel gas generated by 1 litter of the space in the fuel tank 23 when the fuel temperature is raised from $T_0$ to Tn.

Figure 8:
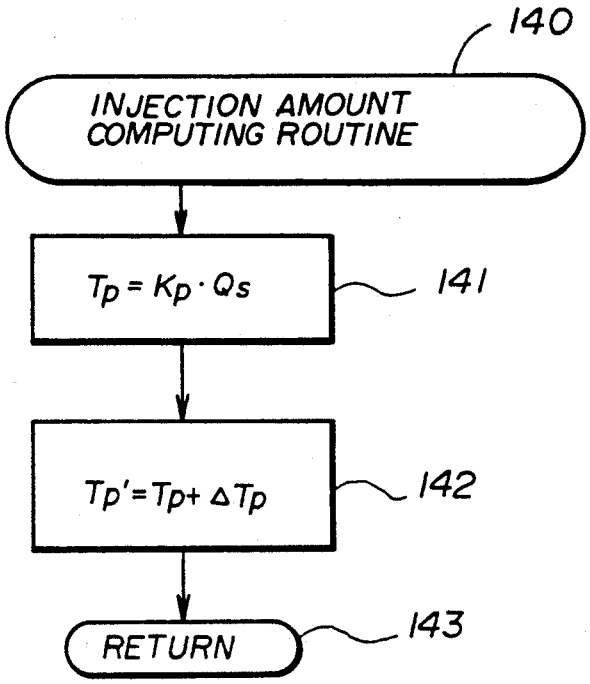
FIG. 8 is a flow chart of a routine 140 for computing the amount of fuel to be injected.

The correction value Δ Tp for correcting the air-fuel ratio is sent to the ECU 22. FIG. 8 is a flow chart of a routine 140 for computing the amount of fuel to be injected, which routine is executed by the ECU 22.

In step 141, a basic amount of fuel Tp to be injected by the fuel injection valve 45 is calculated by multiplying the factor Kp, used in the step 126 of the routine 120, by the amount of air Qs obtained from the air flow sensor 42. The amount of fuel Tp is equal to an amount of fuel to be injected into the intake pipe 41 when the evaporative fuel gas is not purged so that the stoichiometric air-fuel ratio for the amount of air Qs is realized.

In step 142 an actual amount of fuel Tp' to be injected by the fuel injection valve 45 is calculated by adding the correction value Δ Tp, which is obtained by the execution of the routine 120, to the basic amount of fuel Tp obtained in the step 141. The routine 140 ends in step 143.

As mentioned above, the correction amount of the fuel Δ Tp to be injected, which corrects the air-fuel ratio of the mixture gas suctioned into the engine to be the stoichiometric ratio, can be obtained by the routine 120. Therefore the amount of the injected fuel is appropriately controlled even though a ratio of fuel vapor to air in the evaporative fuel gas is changed; thus optimum control is realized of the air-fuel ratio under any conditions of the engine.

Additionally, according to the embodiment mentioned above, optimum control of the air-fuel ratio allow the evaporative fuel gas not to pass through the canister 30 while the engine is running. This can assist in preventing the canister from deteriorating because the evaporative fuel gas generated while the engine is running contains compositions of high boiling points which causes a deterioration of the adsorbent in a canister.

It is to be noted that the amount of flow of the evaporative fuel gas purged from the solenoid valve 31 can be directly measured by having a flow sensor in the direct line 26a. And also, the ratio of fuel vapor to air can be detected by having a sensor that detects the concentration of fuel vapor in the evaporative fuel gas. The idea of the correction of the fuel to be injected is that computing the net amount of fuel vapor and the amount of air contained in the evaporative fuel gas in the fuel tank 23; decreasing the amount of fuel to be injected from the fuel injection valve 45 when an actual air-fuel ratio is in rich side from the stoichiometric air-fuel ratio; increasing the amount of fuel to be injected when the actual ratio is in lean side from the stoichiometric ratio.

The above mentioned apparatus is invented on the assumption that the total amount of evaporative fuel gas generated in a fuel tank is immediately purged into the intake pipe. However, there is a possibility that the correction of the amount of fuel becomes inaccurate. In such a condition, where the engine is heavily loaded, since a pressure inside the intake pipe is increased, a pressure difference between the intake pipe and the fuel tank is decreased. This results in a decrease of the purged amount of evaporative fuel gas and an increase of pressure inside the fuel tank caused by the remaining evaporative fuel gas in the fuel tank. Due to this pressure rise in the fuel tank, an actual amount of fuel purged into the intake pipe may become greater than the value computed according to the temperature of the fuel.

Next, a description will be given of a second embodiment of the present invention with reference to FIGS. 12–17. In FIGS. 12–17, those parts that are the same as corresponding parts in FIGS. 1–11 are designated by the same reference numerals as previously, and descriptions thereof will be omitted.

Figure 12:
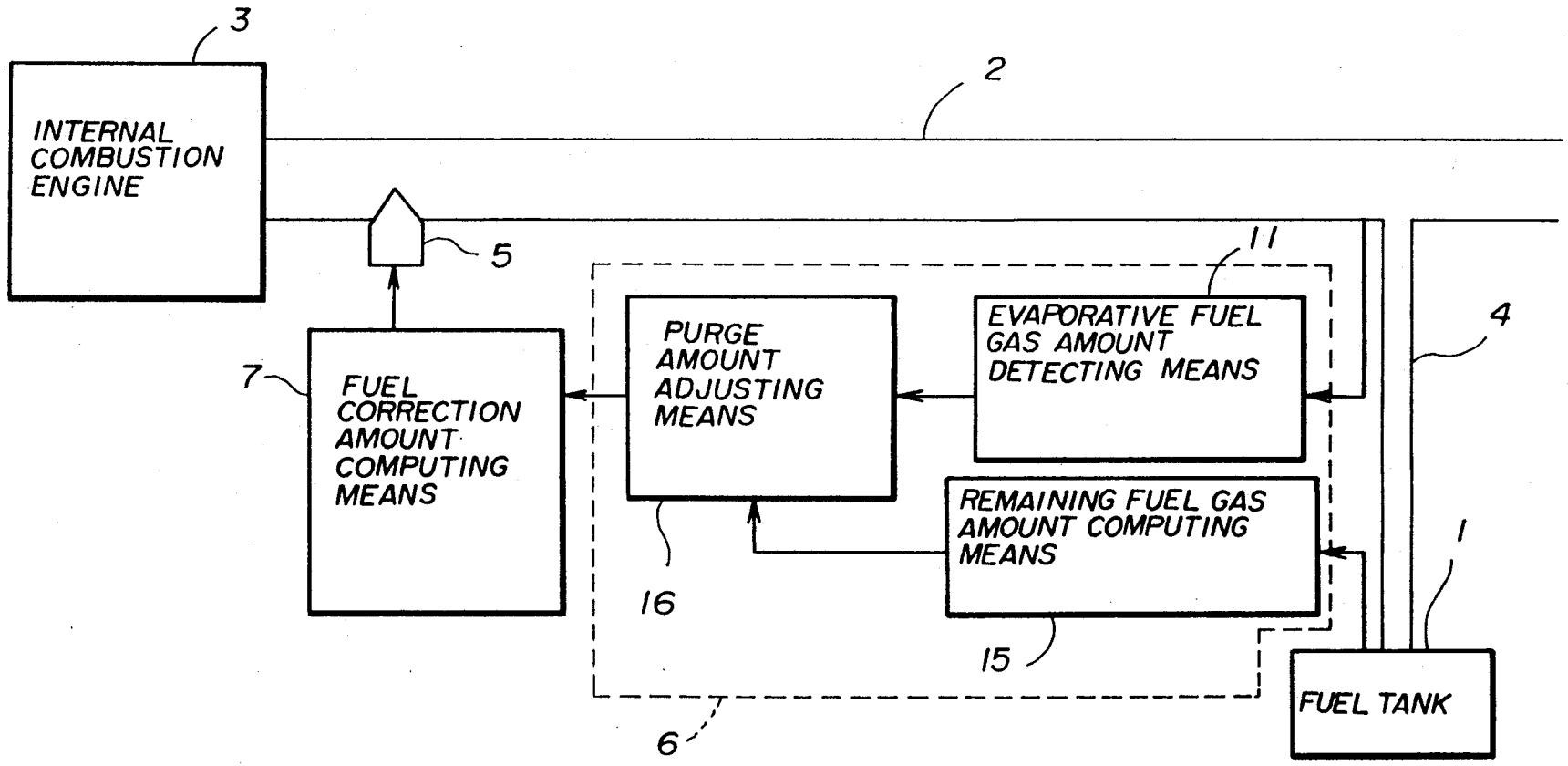
FIG. 12 is a schematic block diagram for explaining a system of a second embodiment of the present invention.

As shown in FIG. 12, in this embodiment, the computing means 6 for computing the net amount of vapor fuel shown in FIG. 1 includes detecting means for detecting an amount of evaporative fuel gas 11, computing means 15 for computing an amount of remaining fuel in the fuel tank 1, and correcting means 16 for computing an amount of evaporative fuel gas to be purqed to an intake passage 2.

The computing means 7 for computing a correction amount of fuel is the same as that used in the first embodiment of the present invention, shown in FIG. 1.

In this embodiment the computing means 15 for computing an amount of remaining amount of fuel in the fuel tank 1 computes a remaining evaporative fuel in the fuel tank 1. The correcting means 16 computes an amount of evaporative fuel gas to be purged into the intake passage 2 based on the amount of the remaining evaporative fuel gas as computed by the means 15. The computing means 7 of this embodiment computes an accurate correction amount of fuel based on the corrected amount of evaporative fuel gas as computed by the correcting means 16.

Figure 13:
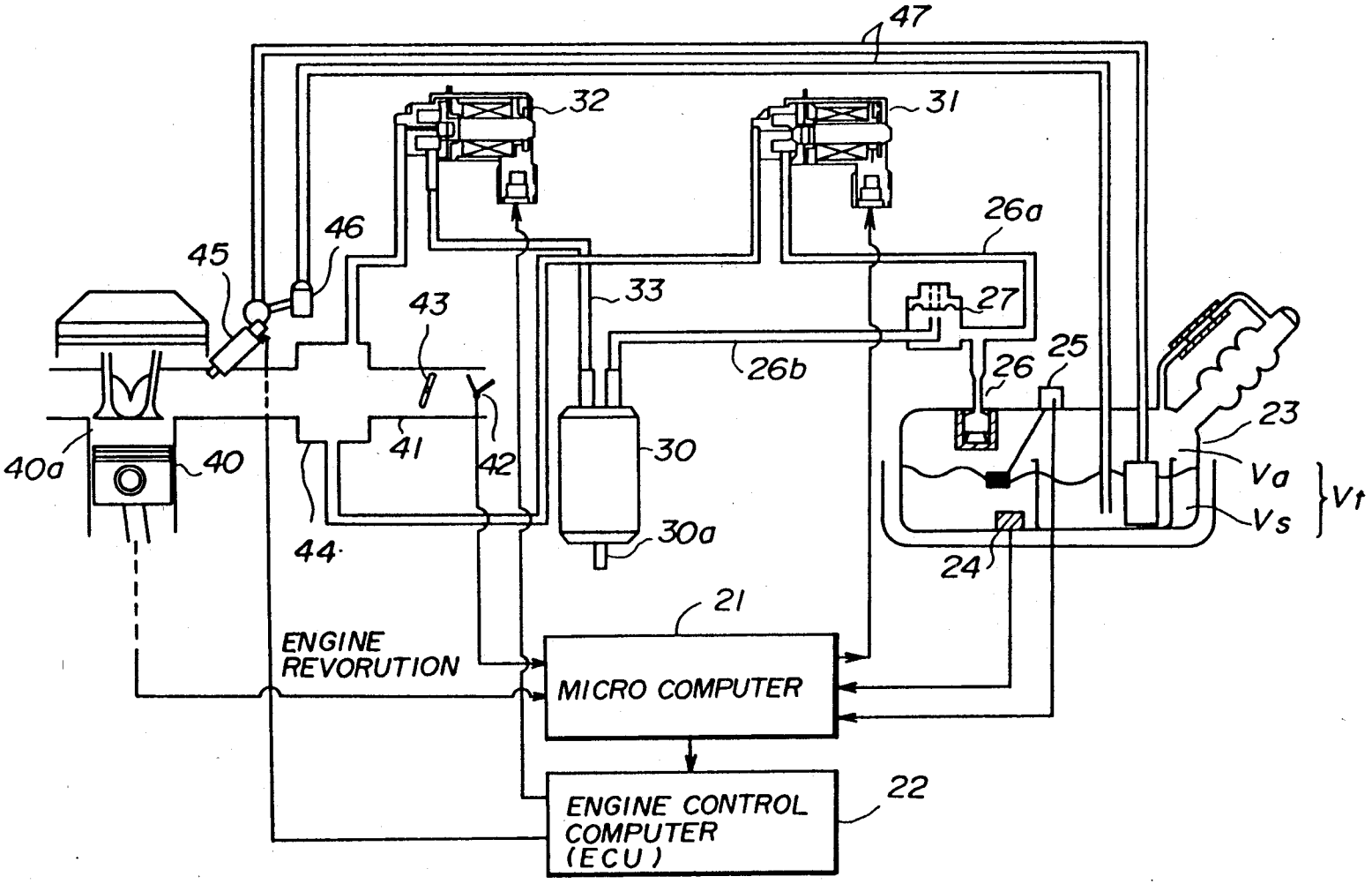
FIG. 13 is a schematic illustration of a system construction of the second embodiment of the present invention.
Figure 14:
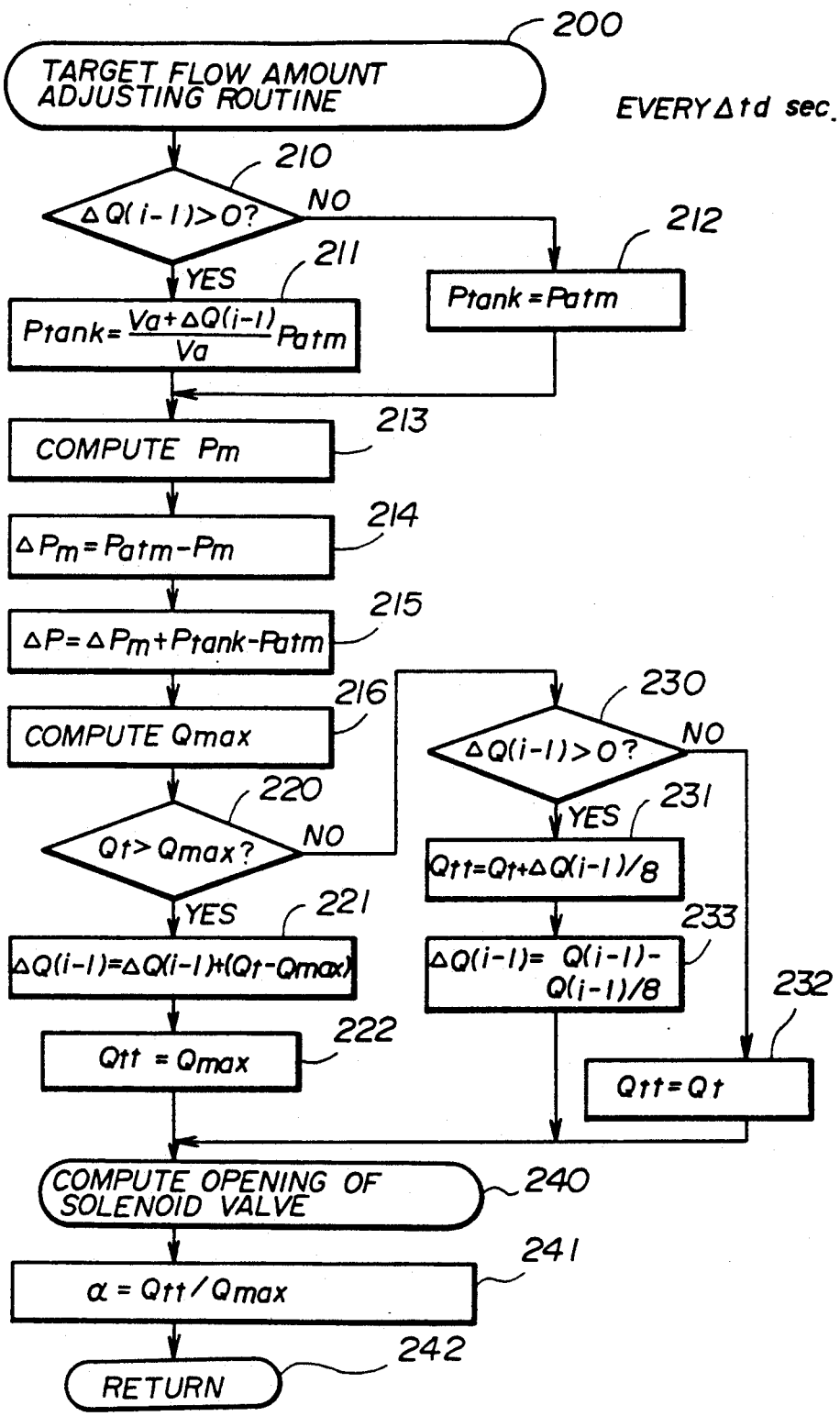
FIG. 14 is a flow chart of a routine for adjusting a target flow amount.

FIG. 13 is a schematic illustration of a system construction of the second embodiment of the present invention. The system of this embodiment is the same as that of the above mentioned first embodiment except that in this embodiment, an engine revolution is supplied to the microcomputer 21. The microcomputer 21 of this embodiment comprises the same parts as that of the first embodiment shown in FIG. 3. The microcomputer 21 reads a signal of the engine revolution in the same manner as that of the first embodiment.

A block diagram of the microcomputer 21 of this embodiment is represented by that of the first embodiment shown in FIG. 4. Means 60 for computing a flow amount of the solenoid valve 31 computes the amount of evaporative fuel gas as well as the amount of evaporative fuel gas remaining in the fuel tank 23. A pressure difference between an inlet and an Outlet of the solenoid valve 31 is obtained due to a pressure increase in the fuel tank 23 caused by the remaining evaporative fuel and a negative pressure of the intake pipe 41, which negative intake pressure is in response to a load of the engine. The degree of opening of the solenoid valve is determined in proportion to the maximum flow through the solenoid valve 31 at the above pressure difference and the actual flow of the evaporative fuel gas.

Data concerning the determined degree of valve opening is then sent to the means 70 so as to control the solenoid valve 31 to allow a target amount of evaporative fuel to flow through the solenoid valve 31. The means 80 for computing a correction amount of the fuel computes the excess amount of fuel vapor and air flowing into the intake pipe 41 so as to correct the opening time interval of the fuel injection valve 45 as computed by the ECU 22.

Since a process of the detecting means 11 is the same as that of the first embodiment, a description of the detecting means 11 and its processing routine for computing the target amount of flow of the valve 31 will be omitted.

Figure 15:
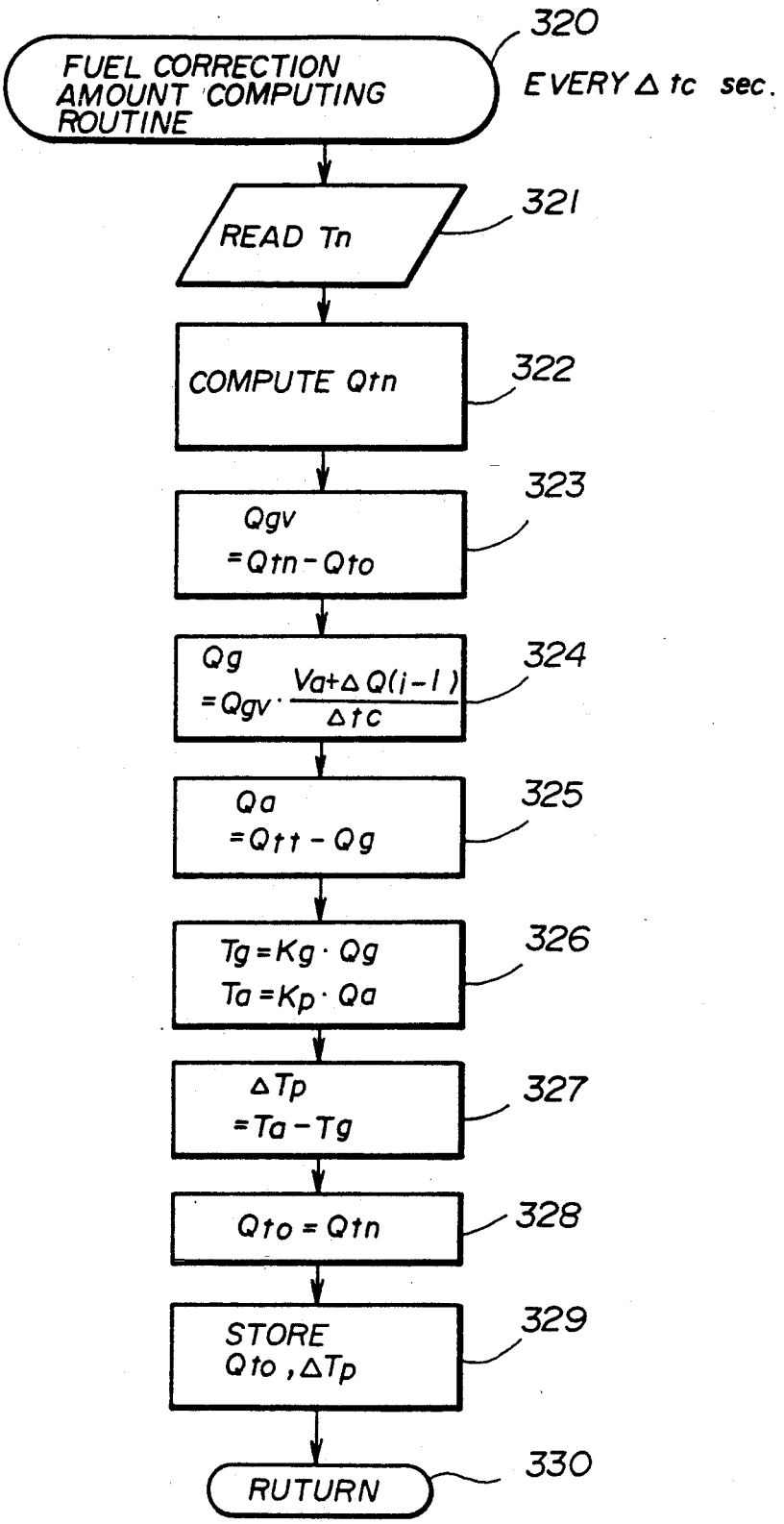
FIG. 15 is a flow chart of a routine for computing a fuel correction amount.

In this embodiment, the target amount of flow Qt is corrected by the computing means 14 for computing an amount of remaining fuel in the fuel tank 23 and the correcting means 16 for computing an amount of evaporative fuel gas to be purged into the intake passage 2. A routine 200 shown in FIG. 15 is a process for correcting the target amount of flow Qt obtained by the routine 100.

The routine 200 is executed every Δ td seconds by the means 60 of FIG. 4. First, in step 210, it is judged whether or not there is a remaining evaporative fuel gas Δ Q (i−1) in the fuel tank 23.

If there remains an amount of evaporative fuel gas, that is, Δ Q (i−1)>0, the process proceeds to step 211. In the step 211, a coefficient of pressure rise in the fuel tank 23 is obtained by adding Δ Q (i−1) to the volume of the empty space Va and dividing the result by Va. A pressure Ptank in the fuel tank 23 of the present time is calculated by multiplying the factor (Va ΔQ (i−1))/ Va by Patm, the atmospheric pressure. The factor is obtained based on the principle that a result of the multiplication of a volume and a pressure is constant, PV=const. At this moment, the control valve 27 on the canister line **26*b*** is closed.

If it is judged, in the step 210, that there is no remaining evaporative fuel gas in the fuel tank 23, that is, Δ Q (i−1)=0, Ptank is substituted by Patm in step 212.

Figure 16:
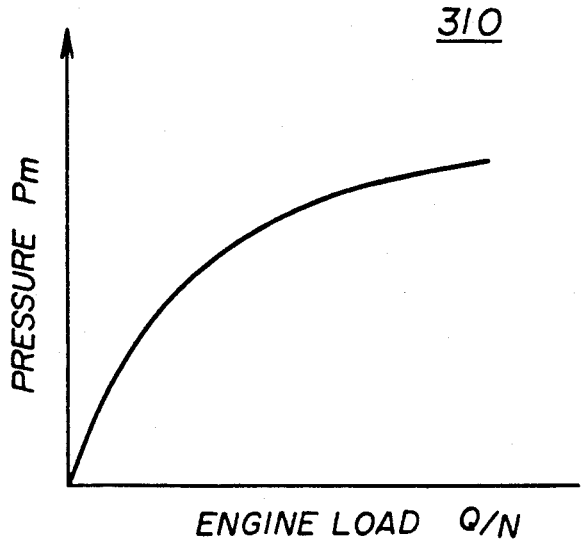
FIG. 16 is a graph showing a relationship between load condition and a negative pressure in an intake pipe.
Figure 17:
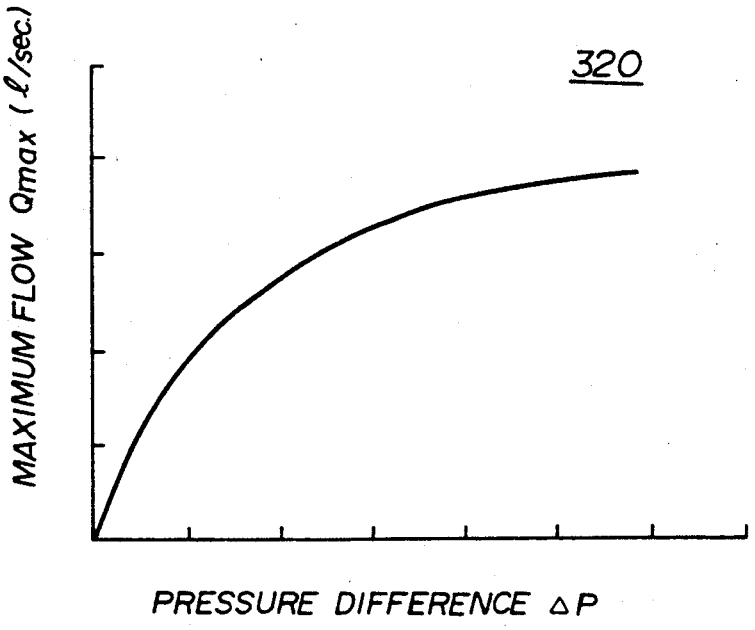
FIG. 17 is a graph showing a relationship between maximum flow amount of the solenoid valve and a pressure difference between an inlet and an outlet of a solenoid valve.

Next, in step 213, a negative pressure Pm inside the intake pipe 41, which pressure is in response to a load applied to the engine, is calculated by interpolation in accordance with a map 310 shown in FIG. 16. The map 310, obtained by experiment, is a relationship between a value Q/N and a negative pressure Pm, where Q is an amount of suctioned air Q in the intake pipe 41 and N is a revolution of the engine 40. Data concerning the amount of suctioned air Q is supplied from the RAM 52, which data was received from the air flow sensor 42 and stored in the RAM 52 beforehand. The value Q/N is generally used as an indicating value for load conditions of an engine.

As shown in map 310, the negative pressure Pm in the intake pipe 41 increases as the load applied to the engine increases.

In step 214, a pressure difference Δ Pm between the inlet and Outlet of the solenoid valve 31 is obtained by subtracting the negative pressure Pm from the atmospheric pressure Patm, which is in a case that the pressure inside the fuel tank is equal to the atmospheric pressure. In this case, the amount of remaining evaporative fuel is not considered.

The above mentioned pressure Ptank Patm calculated in the step 211 represents an increased pressure in the fuel tank caused by the remaining evaporative fuel gas. Accordingly, in step 215, the pressure difference Δ P is calculated by adding the pressure Ptank Patm to the pressure difference Δ Pm obtained in the step 214. The pressure difference Δ P represents a pressure difference between the inlet and outlet of the solenoid valve 31 in a condition where an amount of evaporative fuel remains in the fuel tank 23. Accordingly, Δ P is greater than Δ Pm as a result of the increased pressure in the fuel tank 23.

Figure 18:
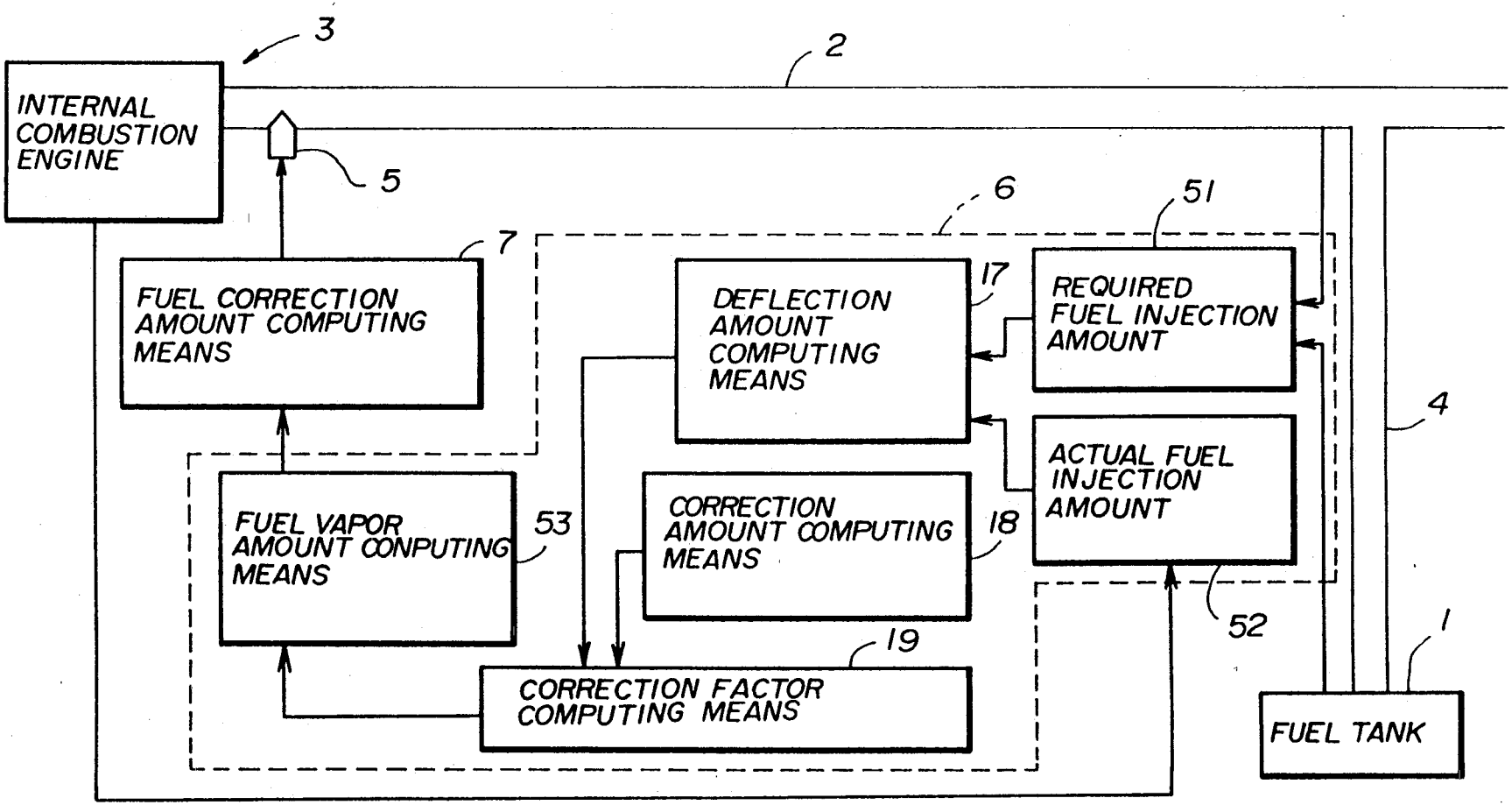
FIG. 18 is a schematic block diagram for explaining a system of a third embodiment of the present invention.

Next, in step 216, the maximum flow amount Qmax, which is a flow amount flowing through the solenoid valve 31 at a pressure difference of Δ P, is calculated by interpolation in accordance with the map 320 shown in FIG. 18. The map 320 is a relationship between the pressure difference Δ P obtained in the step 215 and the maximum flow amount Qmax of the solenoid valve 31. The maximum flow amount Qmax is proportional to $(Ptank-Patm)^{\frac{1}{2}}$, $Qmax \propto (Ptank-Patm)^{\frac{1}{2}}$.

In step 220, a comparison of the target amount Qt and the maximum flow amount Qmax is executed to judge whether or not Qt is greater than Qmax. If Qt>Qmax, the portion of evaporative fuel gas represented by Qt−Qmax will remain in the fuel tank 23 at present time. Thus, in step 221, Qt Qmax is added to the remaining amount Δ Q (i−1) of evaporative fuel gas so as to prepare for the next execution of this routine. Then in the next step 222, a new corrected target amount of flow Qtt is substituted by Qmax.

On the other hand, if the target amount of flow Qt is smaller than the maximum flow amount Qmax, Qt<Qmax, the whole amount of evaporative fuel gas generated in the fuel tank will be purged to the intake pipe 41 via the solenoid valve 31. Now, in step 230, it is judged whether or not there is a remaining evaporative fuel gas Δ Q (i−1) in the fuel tank 23, as is done in the step 210. The reason for this judgement is that if there is a remaining evaporative fuel gas, a process executed in the next step 231 is needed in order to eliminate the remaining evaporative fuel gas from the fuel tank 23.

If there is a remaining evaporative fuel gas in the tank 23, in step 233, a new corrected target amount of flow Qtt is calculated by adding one-eighth of the amount of the remaining evaporative fuel gas Δ Q (i−1) to the target amount of flow Qt that is based on the amount generated at the present time. Accordingly, an amount of remaining evaporative fuel gas Δ Q (i−1) for the next execution will be the result of subtracting the one-eighth of the amount of the remaining evaporative fuel gas $\Delta Q(i-1)$ from the amount of the remaining evaporative fuel gas $\Delta Q(i-1)$ at the present time.

As mentioned above, by limiting the amount of evaporative fuel added to the target amount of flow Qt to one-eighth of the amount of the remaining evaporative fuel gas, an excessive amount of evaporative fuel flow into the intake pipe 41 from the fuel tank 23 is prevented and thus a large change in air-fuel ratio is prevented. Since the routine 120 is executed repeatedly, the amount of remaining evaporative fuel gas will be gradually reduced until it becomes nil, although the amount of evaporative fuel added to the target amount of flow Qt is limited to one-eighth of the amount of the remaining evaporative fuel gas.

If there is no remaining evaporative fuel in the fuel tank 23, the routine proceeds to step 232 and the new target amount Qtt is simply substituted by the target amount of flow Qt.

Next, the routine proceeds to step 240, where a calculation of opening of the solenoid valve is executed in order to determine the appropriate degree of opening for the new target amount Qtt. In step 241, a degree of opening of the solenoid valve 31 is determined in proportion to the new target amount Qtt and the maximum amount of flow Qmax; the routine ends in step 242.

As described above, the computing means 15 for computing a remaining amount of evaporative fuel gas, and the correcting means 16 for computing an amount of evaporative fuel gas to be purged into the intake passage 2, both shown in FIG. 12, are realized by the steps 210-240.

Next, a description will be given of a process of the means 80 for computing a correction amount of the fuel injected to the intake pipe 41 by the fuel injection valve 45. The idea of the correction of the fuel to be injected is that computing the net amount of fuel vapor and the amount Of air contained in the evaporative fuel gas in the fuel tank 23; decreasing the amount of fuel to be injected from the fuel injection valve 45 when an actual air-fuel ratio is in rich side from the stoichiometric air-fuel ratio; increasing the amount of fuel to be injected when the actual ratio is in lean side from the stoichiometric ratio.

FIG. 15 is a flow chart of a routine 320 for the correction of the amount of fuel to be injected by the fuel injection valve 45. The routine 320 is executed every $\Delta$ Tc seconds, similarly to the above mentioned routine 200, by the means 80 of FIG. 4. First, in step 321, the CPU 50 reads the fuel temperature data Tn, which data was received from the temperature sensor 24 and stored in the RAM 52. Next, in step 322, the net amount of the fuel vapor Qtn is computed in accordance with a map 220 shown in FIG. 11. The map 220 is a relationship, obtained by experiment, between the fuel temperature T and the integrated amount of generated fuel vapor Qt generated by 1 liter of volume in the fuel tank 23 at the temperatures from $-20°$ C. to T° C.

Next, the amount of fuel vapor Qgv, generated when the fuel temperature is raised from $T_0$ to Tn, is obtained in step 323. The amount of evaporative fuel gas Qgv can be represented by the difference between the amount of generated fuel vapor of the last time $Qt_0$ and Qtn of the present time. In other words, the amount of fuel vapor Qgv can be calculated as per the equation $Qgv = Qtn - Qt_0$.

The amount of fuel vapor Qgv is an integrated amount of fuel vapor generated by 1 liter of volume in the fuel tank 23 at temperatures from $T_0$ to Tn. In this embodiment, since the remaining amount of the evaporative fuel gas in the fuel tank 23 is considered, the volume of empty space in the tank 23 becomes a sum of the actual empty space Va of the tank 23 and the amount of remaining evaporative fuel $\Delta Q(i-1)$, which is an amount calculated in the step 210 the last time the routine 200 was executed. Accordingly, in the step 324, the amount of fuel vapor Qg (liters/sec) of the present time is calculated by the equation $Qgv \times (Va + \Delta Q(i-1))/\Delta tc$.

In step 325, the amount of air Qa (liters/sec) contained in the evaporative fuel gas is calculated by subtracting the amount of fuel vapor Qg from the new target amount of evaporative fuel gas flow Qtt of the routine 200. In step 326, converted values for the fuel injection amount Tg and Ta are calculated by respectively multiplying factors Kg and Kp. The factor Kg is for converting the amount of fuel represented by liters, purged from the solenoid valve 31, to the amount of fuel to be injected from the fuel injection valve 45 (duration of injection time). The factor Kp is for converting the amount of air contained in the evaporative fuel gas purged from the solenoid valve 31 to the amount of fuel to be injected from the fuel injection valve 45 (duration of injection time).

Next, in step 327, a correction value $\Delta$ Tp of the amount of fuel of fuel injection is calculated by subtracting the Tg from the Ta. If $Ta > Tg$, that is $\Delta$ Tp is a positive number, the mixing ratio of the amounts of fuel vapor and air in the evaporative fuel gas of the target amount Qtt obtained by execution of the routine 200, is in the rich side of the stoichiometric air-fuel ratio. If $Ta < Tg$, that is $\Delta$ Tp is a negative number, the mixing ratio of the amounts of fuel vapor and air of the evaporative fuel gas, contained in the target amount Qtt, is in the lean side of the stoichiometric air-fuel ratio.

When the evaporative fuel gas purged from the solenoid valve 31 has the same air-fuel ratio as the stoichiometric air-fuel ratio, Ta is equal to Tg, that is $\Delta Tp = 0$.

In step 328, in preparation for the next execution, $Qt_0$ is substituted by the amount of the generated evaporative fuel Qtn at the present time. In step 129, the revised $Qt_0$ and $\Delta$ Tp obtained in the step 127 are stored in the RAM 52; the routine 120 ends in step 130.

As mentioned above, by execution of the routine 320, the corrected amount of fuel vapor Qg can be obtained in accordance with the amount of the remaining evaporative fuel in the fuel tank 23; the corrected amount of air Qa in the evaporative fuel gas is computed from the net amount of the fuel vapor and the amount of the evaporative fuel gas; the correction value $\Delta$ Tp for correcting the air-fuel ratio to be the stoichiometric ratio can be thus obtained.

It is to be noted that, although the amount of fuel vapor Qgv, generated when the fuel temperature is raised from $T_0$ to Tn, is obtained by the map 220, used in step 322, Qgv can be calculated by the equation (3) explained in the first embodiment mentioned above.

The correction value $\Delta$ Tp for correcting the air-fuel ratio is sent to the ECU 22. Since a routine for computing the amount of fuel to be injected, which routine is executed by the ECU 22, is similar to that of the first embodiment, a description thereof will be omitted.

As mentioned above, the correction amount of the fuel $\Delta$ Tp to be injected, which can correct the air-fuel ratio of the mixture gas suctioned into the engine to be the stoichiometric air-fuel ratio, can be obtained by the routine 320. The correction amount of the fuel$\Delta$ Tp is obtained by considering the amount of remaining evaporative fuel in the fuel tank so that the target amount of evaporative fuel gas to be purged into the intake pipe becomes accurate. Therefore the amount of the injected fuel is appropriately controlled even though a ratio of fuel vapor to air in the evaporative fuel gas is changed, and thus an optimum control of the air-fuel ratio under any conditions of the engine is realized.

Additionally, since the remaining evaporative fuel gas in the fuel tank is also purged by portions together with the generated evaporative fuel gas at present time, an pressure increase in the fuel tank is prevented; whole evaporative fuel gas generated while the engine is running is not flown into the canister but is purged into the intake pipe and thus maximization of the canister can be eliminated.

Further, according to the embodiment mentioned above, optimum control of the air-fuel ratio allows the evaporative fuel not to pass through the canister 30 while the engine is running. This can assist in prevention of canister deterioration because the evaporative fuel, generated while the engine is running, contains high boiling point compositions; this causes a deterioration of the adsorbent in the canister.

Next, a description will be given of a third embodiment of the present invention with reference to FIGS. 18-31. In FIGS. 18-31, those parts that are the same as corresponding parts in FIGS. 1-12 are designated by the same reference numerals from figure to figure, and descriptions thereof will be omitted.

In the above mentioned embodiments, there is a possibility that the computed amount of evaporative fuel gas and fuel vapor deviates from the actually required value due to changes in the atmospheric pressure and to variation of fuel composition. This results in inaccurate control of the air-fuel ratio, which leads to bad condition of the exhaust emission.

The third embodiment of the present invention is designed to eliminate the above mentioned problem by having means for correcting the amount of fuel to be injected by comparing the actual fuel amount injected and the required fuel amount in a standard condition.

FIG. 18 is a block diagram for explaining a principle of the third embodiment of the present invention n. In this embodiment a provided computing means 17 for computing a difference ($\Delta$ G ) between a required amount of fuel to be injected 51, obtained from a first map, and an amount of actually injected fuel 52, computing means 18 for computing a correction amount ($\Delta$ TPT) in a standard condition, and computing means 19 for computing a factor of correcting amount (KG) for obtaining a second map 53 correcting so as to have the first map correspond to an actual condition. The above mentioned first map is a relationship between fuel temperature and a generated amount of evaporative fuel gas in a specified standard condition, and the second map is a corrected first map in accordance with$\Delta$ G and $\Delta$ TPT.

In the specified standard condition, the above $\Delta$ G becomes zero since the amount of actually injected fuel 52 equals to the required amount of fuel to be injected 51, which required amount is obtained based on the first map. Accordingly, $\Delta$ G represents the difference between the amount of generated evaporative fuel gas of an actual condition (Qgv') and that of the specified standard condition (Qgv). The correction amount $\Delta$ TPT equals the amount of the specified standard condition Qgv. Therefore the equation $Qgv' = \Delta TPT + \Delta G$ is obtained. Since the coefficient KG is for correcting the first map to the second map, KG is calculated by $Qgv'/Qgv$. Accordingly, $Qgv' = KG \times Qgv = KG \times \Delta TPT$ is obtained. In a process executed by the means 19, KG is computed as per the equation $KG = 1 + (\Delta G/\Delta TPT)$, and the second map is obtained.

The computing means 7 of this embodiment computes, as in the case of the above mentioned first and second embodiments, an accurate fuel correction amount of based on the corrected amount of evaporative fuel gas as computed by the computing means 17.

Figure 19:
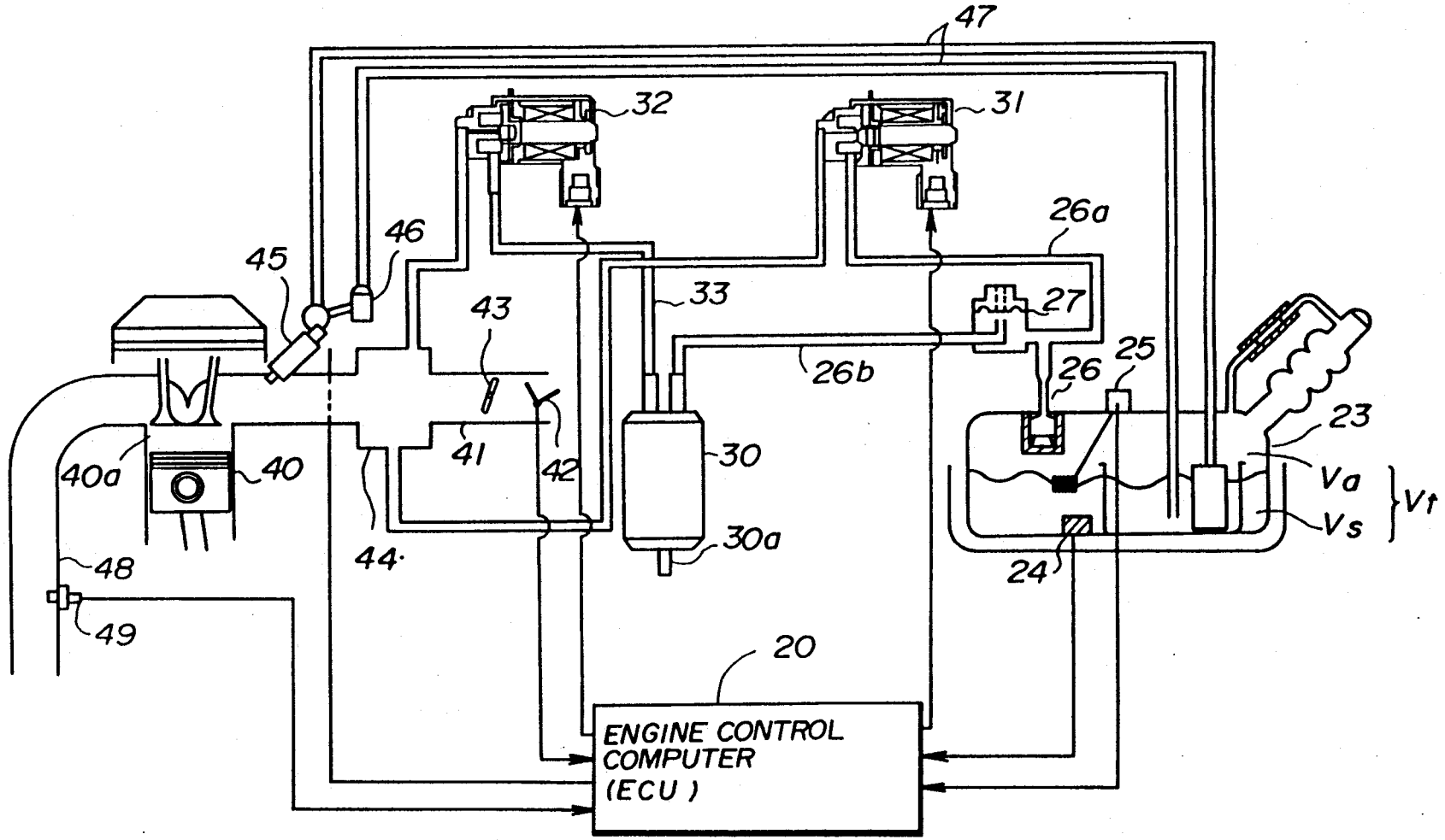
FIG. 19 is a schematic illustration of a system construction of the third embodiment of the present invention.

FIG. 19 is a schematic illustration of a system construction of the third embodiment of the present invention. In FIG. 19, those parts that are the same as corresponding parts in FIG. 2 are designated by the same reference numerals, and descriptions thereof will be omitted.

Used as the internal combustion engine 3 of FIG. 18, is a 4-stroke spark ignition type internal combustion engine 40, controlled by an engine control computer (ECU) 20.

In a fuel tank 23, there are provided a fuel temperature sensor 24 and a fuel level sensor 25 used for measuring a fuel amount remaining in the fuel tank 23. Signals from the sensors 24 and 25 are supplied to the ECU 20.

Reference numeral 41 an intake pipe, which corresponds to the intake passage 2 of FIG. 18, is connected to the engine 40. On the intake pipe 41, there is provided an air flow sensor 42, a throttle valve 43, a surge tank 44, and a fuel injection valve 45. The air flow sensor 42 detects an amount of air flowing inside the intake pipe 41 so as to supply a related signal to the ECU 20. The throttle valve 43 is connected to an acceleration pedal, not shown in the figure. The surge tank 44 is provided for suppressing a pulsation of suction air flowing in the intake pipe 41.

There are provided fuel circulation tubes 47 between the fuel injection valve 45 and the fuel tank 23, allowing fuel in the fuel tank 23 to circulated by a circulation pump 46. An amount of fuel is injected into the intake pipe 41 by the fuel injection valve 45 when the valve is open in accordance with a command from the ECU 20. The amount of fuel injected by the valve 45 is proportional to the time for which the valve 45 is open.

A vapor line 26 connects the fuel tank 23 and a control valve controlling a pressure inside the fuel tank 23. A direct line 26*a*, corresponding the connection passage 4 of FIG. 19, connects the control valve 27 and the surge tank 44 of the intake pipe via a vacuum switching valve (VSV) 31, which valve is a solenoid valve. A canister line 26*b* connects the control valve 27 and a canister 30. The canister 30 contains an adsorbent such as activated carbon, and an atmospheric pressure introducing port 30*a* is provided in the lower portion thereof. A purge line 33, which connects the canister 30 and the surge tank 44 via another solenoid valve 32, is provided. The control valve 27 prevents evaporative fuel gas from the fuel tank from flowing into the canister 30 while the engine is running. The solenoid valve 31 controls an amount of evaporative fuel gas flowing from the fuel tank 23 to the surge tank 44 of the intake pipe 41 by adjusting a valve opening in response to a signal supplied from the ECU 20. The solenoid valve 31 also controls an application of a negative pressure from inside the intake pipe 41 to the fuel tank 23, so as to prevent generation of additional evaporative fuel gas in the fuel tank 23. The direct line 26a and the purge line 33, both of which serve for flow therein for the evaporative fuel from the fuel tank 23, are connected to the surge tank 44, but they can be alternatively connected to a portion of the intake pipe.

As is known, evaporative fuel generated in the fuel tank 23 while the engine is stopped, is adsorbed by the activated carbon in the canister 30 during passage thereof through the canister line 33, thus releasing of the evaporative fuel into the atmosphere is prevented. The evaporative fuel in the canister 30 is separated from the adsorbent by air introduced from the port 30a of the canister 30; this is performed by utilizing a negative pressure in the surge tank 44, which pressure is generated in an idle time after the starting of the engine. At this time, the solenoid valve 32 is open. The evaporative fuel is suctioned into the intake pipe 41 via the purge line 33, and is then led to the combustion chamber 40a for combustion.

While the engine is continuously running, temperature of fuel circulating between the fuel tank and the fuel injection valve 45 through a fuel circulation line 47 is raised due to the temperature of the valve 45 becoming high as a result of a heat from the engine. The evaporative fuel gas generated in the fuel tank 23, caused by the temperature rise of the fuel, is suctioned through the direct line 26a into the intake pipe 41 by utilizing a negative pressure inside the surge tank 44 when the solenoid valve is appropriately opened.

The difference between the system construction of the third embodiment and that of the first embodiment, shown in FIG. 2, is that an oxygen sensor 49 is provided in an exhaust pipe 48 of this embodiment, which sensor detects a concentration of oxygen in exhaust gas and supplies a signal to the ECU 20.

Figure 20:
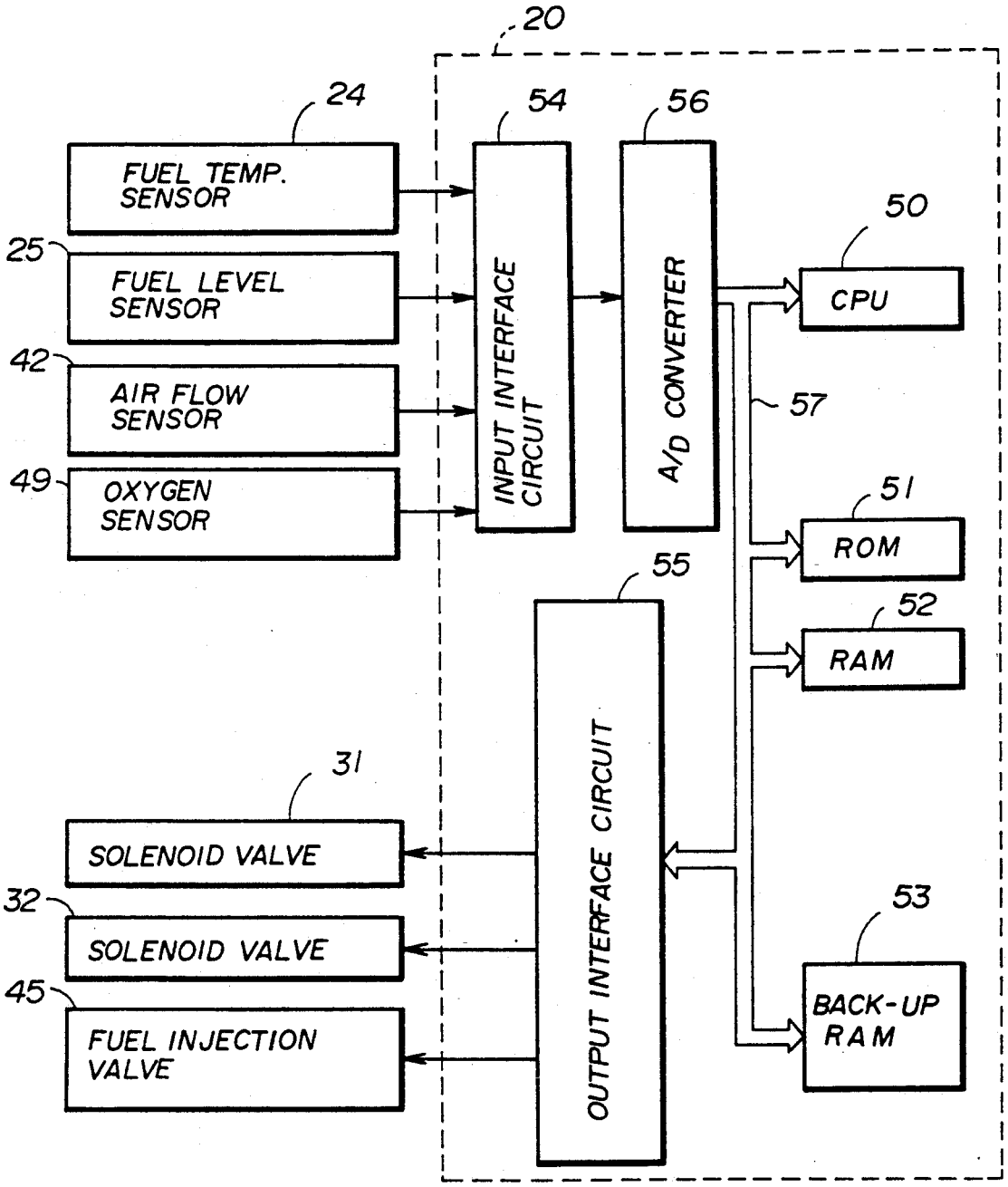
FIG. 20 is a block diagram of the engine control computer 20 shown in FIG. 19.
Figure 21:
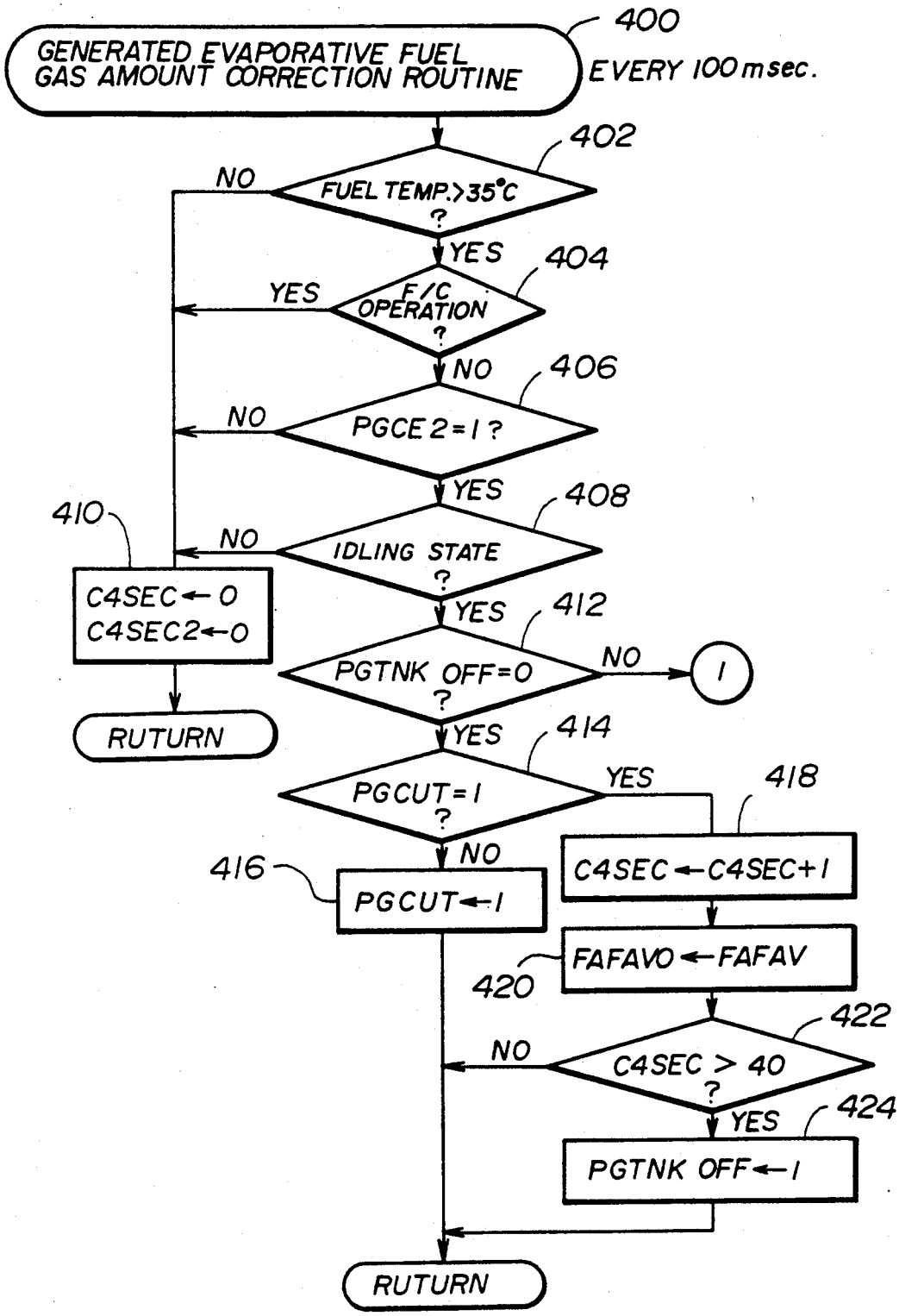
FIG. 21 is a part of a flow chart of a routine for correcting a computed amount of generated evaporative fuel gas.
Figure 22:
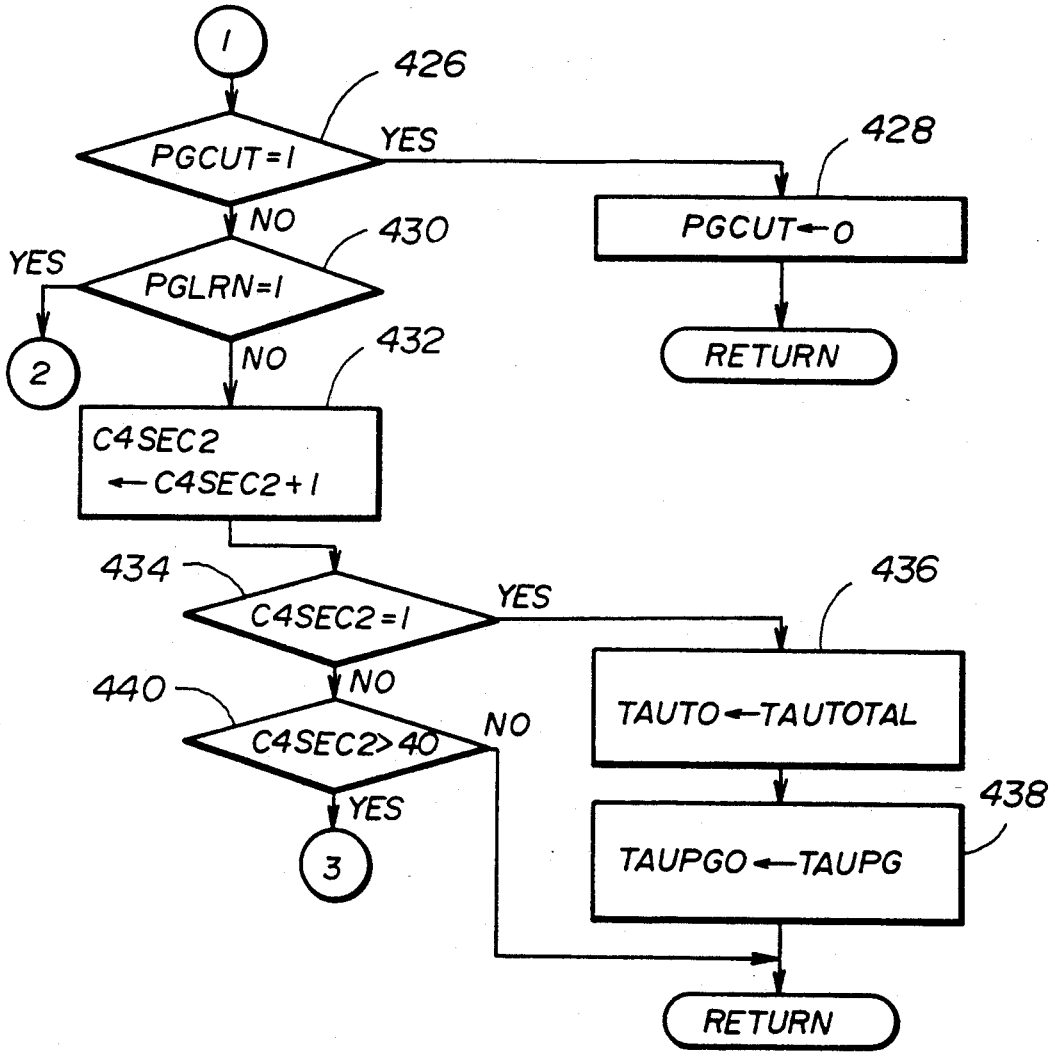
FIG. 22 is a part of the flow chart of the routine for correcting a computed amount of generated evaporative fuel gas.
Figure 23:
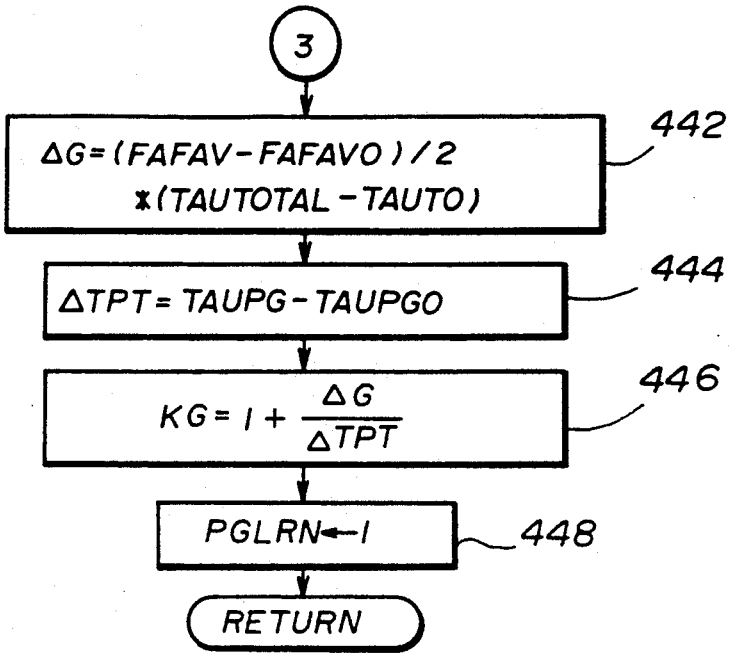
FIG. 23 is a part of the flow chart of the routine for correcting a computed amount of generated evaporative fuel gas.
Figure 24:
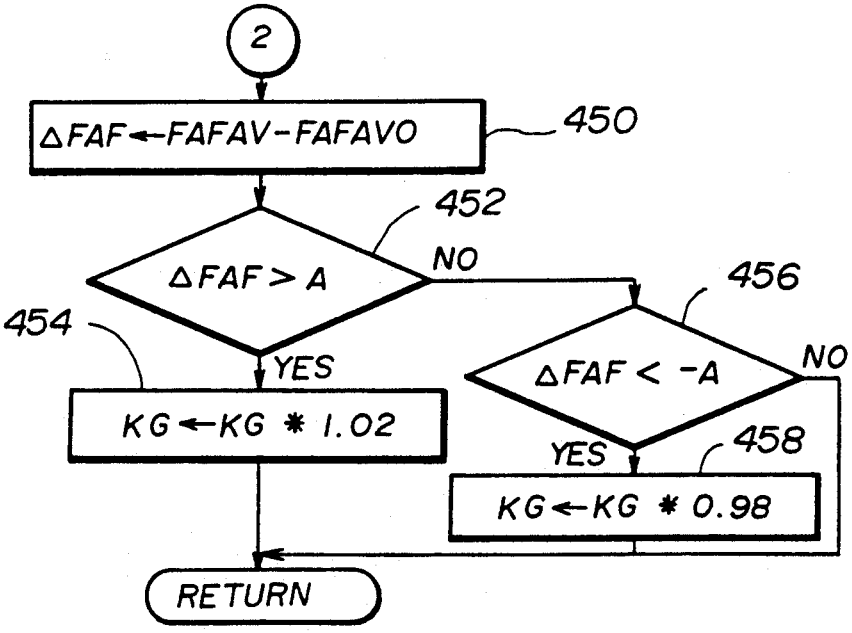
FIG. 24 is a part of the flow chart of the routine for correcting a computed amount of generated evaporative fuel gas.
Figure 25:
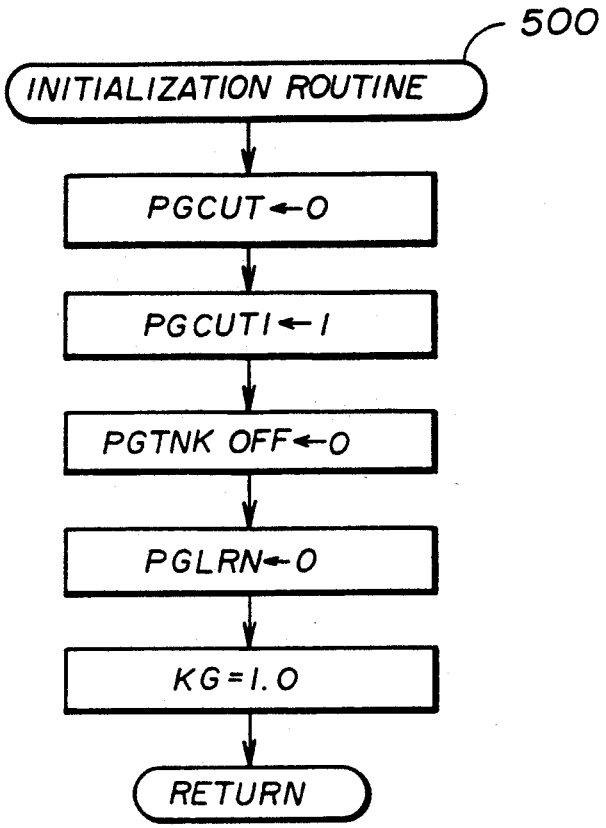
FIG. 25 is a flow chart of a routine for initialization.

The ECU 20 controlling the above mentioned component parts comprises hardware as shown in FIG. 20. In FIG. 20, those parts that are the same as corresponding parts in FIG. 2 are designated by the same reference numerals as previously.

As shown in FIG. 20, the ECU 20 comprises a central processing unit (CPU) 50, a read only memory (ROM) 51, a random access memory (RAM) 52, another RAM 53, an input interface circuit 54, an A/D converter 56 with multiplexer, and an output interface circuit 55, all these connected by a bus 57. The ROM 51 is for storing process programs, the RAM 52 is a working area, and the RAM 53 is for backing up data after the engine stops.

The A/D converter 56 periodically obtains signals concerning fuel temperature from the fuel temperature sensor 24, remaining fuel signals from the fuel level sensor 25, suction air amount signals from the air flow sensor 42, and oxygen concentration signals from the oxygen sensor 49, by switching in turn, and converting them to digital data; it then sends the data to the bus 57. Signals processed by the CPU 50 are supplied to the output interface 55 via the bus 57 in order to control the solenoid valves 31 and 32, and the fuel injection valve 45. The opening of the solenoid valve 32 is controlled in response to the amount of air suctioned by the engine in an idling time after the engine is started. The control of the valve 45 will be explained upon, in the following.

It is to be noted that the ECU 20 of this embodiment serves a combined function of the microcomputer 21 and the ECU 22 in the first and second embodiments mentioned above.

The target amount of flow Qt is determined as a generated amount of evaporative fuel gas that includes the evaporative fuel gas caused by temperature rise of the fuel. The process for computing the target flow is the same as in routine 100 of the first embodiment shown in FIG. 5, and descriptions thereof will be omitted.

A routine of the process for determining the degree of opening of the solenoid valve 31 is the same as the routine 110 of the first embodiment shown in FIG. 7, and descriptions thereof will be omitted.

Next, a description of a generated amount of evaporative fuel for correction of a generated amount of evaporative fuel gas with reference to a routine 400 shown in FIGS. 21–24. In the FIGS, reference numerals ①-⑧ are connection numerals and the routine follows the same numeral, for example, if the routine proceeds to ① of FIG. 21, the routine proceeds to ① of FIG. 22.

The routine 400 is interruptedly starts every 100 msec. After the engine is started, initialization of each flag PGCUT, PGCUT1, PGTNKOFF, PGLRN and KG is executed by a routine shown in FIG. 25. The initial value of PGCUT is 0; of PGCUT1, 1; of PGTNKOFF, 0; of PGLRN, 0; and of KG, 1.0.

When the routine 400 is started, in steps 402–408, 408, it is judged whether or not conditions for computing a correcting amount of evaporative fuel gas are established. In step 402, it is judged whether or not fuel temperature is 35° C. or more. If the fuel temperature is less than 35° C., the routine proceeds to step 410, and the routine ends. This is because when the fuel temperature in less than 35° C., error in the computed amount of generated evaporative fuel gas is negligible. Additionally, when the amount of generated evaporative fuel gas is small, an accurate measurement of the amount of generated evaporative fuel gas can not be performed. By limiting the execution of the routine 400 to only the case when the fuel temperature is 35° C. or more, a high accuracy in computing the correction can be obtained.

In step 404, it is judged whether or not operation of the engine is in fuel cut drive (fuel cut drive, also called F/C drive, is an operation wherein a fuel injection is stopped in deceleration with a throttle valve fully closed in order to save consumption of fuel). Purge of evaporative fuel gas is not executed when the engine is in F/C drive. In step 206, it is judged whether or not an estimation of initial adsorption of the canister 30 is completed, by checking a canister learning flag PGCE supplied from other routines. This is because if an amount of purged evaporative fuel gas passing through the purge line 33, which amount is estimated by an initial adsorption amount, is not known, an error in computing the amount of evaporative fuel gas passing through the direct line 26a will become large. In step 408, it is judged whether or not the engine is in an idling state. This is done because if a load on the engine fluctuates while computing the correction amount, accuracy of the computed amount becomes low. Execution of computing the correcting amount is limited to during an idling operation of the engine.

It is to be noted that the estimation of the initial adsorption amount occurring in the canister 30, in the step 406, is performed after the purge conditions are established and the solenoid valve 31 is opened. This allows elimination of an influence of a direct purge performed from the fuel tank 23, on the estimation of the initial adsorption amount, and thus higher accuracy of estimation is obtained.

Unless all the conditions in the steps 402–408 are satisfied, the routine proceeds to step 410. In the step 410, counters C4SEC and C4SEC2 are reset, and the routine ends.

When all the above conditions are satisfied, the routine proceeds to step 412 where it is judged whether or not the flag PGTNK is 0. At the first execution of the step 412, the routine proceeds to 414 because PGTNK is set to 0 by the initialization mentioned above. In step 414, it is judged whether or not PGCUT is 1. At the first execution of the step 414, the routine proceeds to 416 because PGCUT is set to 0 by the initialization mentioned above. In step 416, the flag PGCUT is set to 1 so as to close the solenoid valve 31 and thus stop a purge operation from the direct line 26*a*, and the routine ends.

The stopping of the purge in the step 416 is in preparation for a measurement of a datum FAFAV(-FAFAV0). This datum FAFAV needs to be measured while the purge is not being performed. Since the purge amount from the purge line 33 has been already estimated, the datum FAFVA can be accurately measured without stopping the purge from the purge line 33.

From the second execution of the step 414, the routine proceeds to step 418 where the counter C4SEC is incremented by 1. This C4SEC was reset in the step 410 before the routine proceeded to the step 418. In the following step 420, the datum FAFAV (FAFAV0) is set by substituting FAFAV for FAFAV0. FAFAV is an average value of the correction factor of feed-back control of the air-fuel ratio FAF. The feed-back control of air-fuel ratio is performed based on a feed-back signal from the oxygen sensor 49 so that an air-fuel ratio becomes the stoichiometric air-fuel ratio. This FAFAV is computed by other routine in the ECU 20.

In the following step 422, it is judged whether not the value of the counter C4SEC is 40 or more, that is, it is judged if 4 seconds have elapsed since the second execution of the routine after all the conditions of the steps 402–414 are satisfied. If C4SEC is less than 40, the routine ends. If C4SEC is 40 or more, the routine proceeds to step 424 where the end of measurement flag PGTANKOFF for the datum FAFAV is set, and the routine ends. Accordingly, FAFAV0 is continuously checked for the elapsing of 4 seconds from the first execution of the step 418 and at the end of the 4 seconds the final datum FAFAV is obtained.

By the steps 414 and 416, the routine can proceed to the step 418 from the second time the routine proceeds to the step 414. This means that the measurement of FAFAV is not performed the first time the routine proceeds to the step 414. This is because the conditions of the engine operation are not stable immediately after the purge is stopped in the step 416, and it is difficult to perform an accurate measurement of the datum FAFAV.

At the execution of the routine 4 seconds after the step 418 has been executed, the routine proceeds to step 426 from the step 412 as PGTNKOFF is set to 1 in the step 424 of the last execution. In step 426, it is judqed whether or not PGCUT is 1. Since PGCUT is set to 1 in the step 416, the routine proceeds to step 428 at the first execution of the step 426. In the step 428, PGCUT is set to 0 and the solenoid valve 31 is opened to allow purging from the direct line 26*a*, and the routine ends.

From the second execution of the step 426, the routine proceeds to step 430 where it is judged whether or not the correction amount learning flag PGLRN is 1. Since PGLRN was reset to 0 at the starting time of the engine by the process shown in FIG. 25, the routine proceeds to step 432. In the step 432, C4SEC2 is revised by incrementing it by 1, the C4SEC2 was reset to 0 in the step 410. In the following step 434, it is judged whether or not the value of C4SEC2 is 1, that is whether or not execution of the step 434 is occurring for the first time. If the execution is the first time, the routine proceeds to step 436 where TAUTO is substituted by TAUTOTAL, then the routine proceeds to step 438 where TAUPG0 is substituted by TAUPG.

Figure 26:
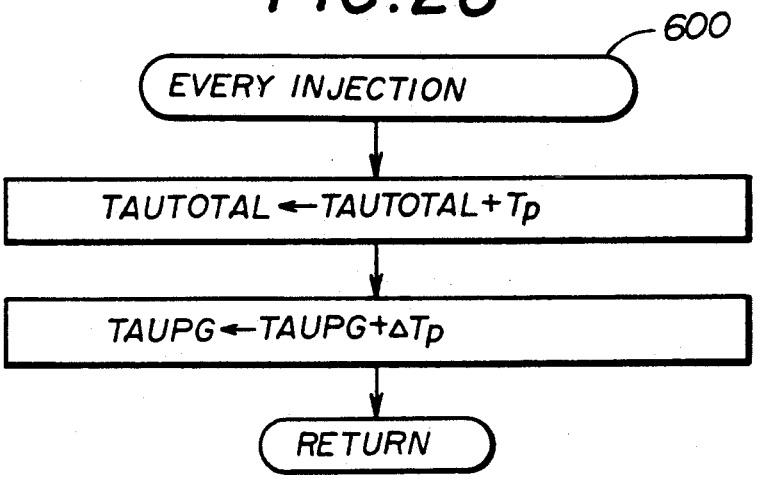
FIG. 26 is a flow chart of a routine executed at every injection of fuel.

TAUTOTAL is an amount obtained by integrating the basic amount of injected fuel TP in every injection executed by a routine 600, which routine is executed for every injection of fuel, shown in FIG. 26. TAUPG is an amount obtained by integrating the correction amount$\Delta$ Tp in every injection. $\Delta$ Tp, which is a correction amount of purged fuel, is an amount for correcting the injection amount Tp when the purge is stopped to be the injection amount Tp' when the purge is executed, this amount is represented by $Tp' = Tp + \Delta Tp$. This $\Delta$ Tp is a correction amount for the standard condition where changes of the atmospheric pressure or the composition of fuel are not considered.

Next, if it is the second or later execution of the step 434, the routine proceeds to step 440. In the step 440, it is judqed whether or not the value of C4SEC2 is 40 or more, that is whether or not 4 seconds have elapsed since the first execution of the step 434. If the C4SEC2 is less than 40, the routine ends. If C4SEC2 is 40 or more, that is, 4 seconds have elapsed, the routine proceeds to step 442 of FIG. 23.

In the step 442, a difference $\Delta$ G is calculated as per the following equation (4).

$$\Delta G = (FAFAV - FAFAV0)/2 \times (TAUTOTAL - TAUT0) \quad (4)$$

In the following step 444, $\Delta$ TPT is calculated as per the following equation (5).

$$\Delta TPT = TAUPG - TAUPG0 \quad (5)$$

Figure 27:
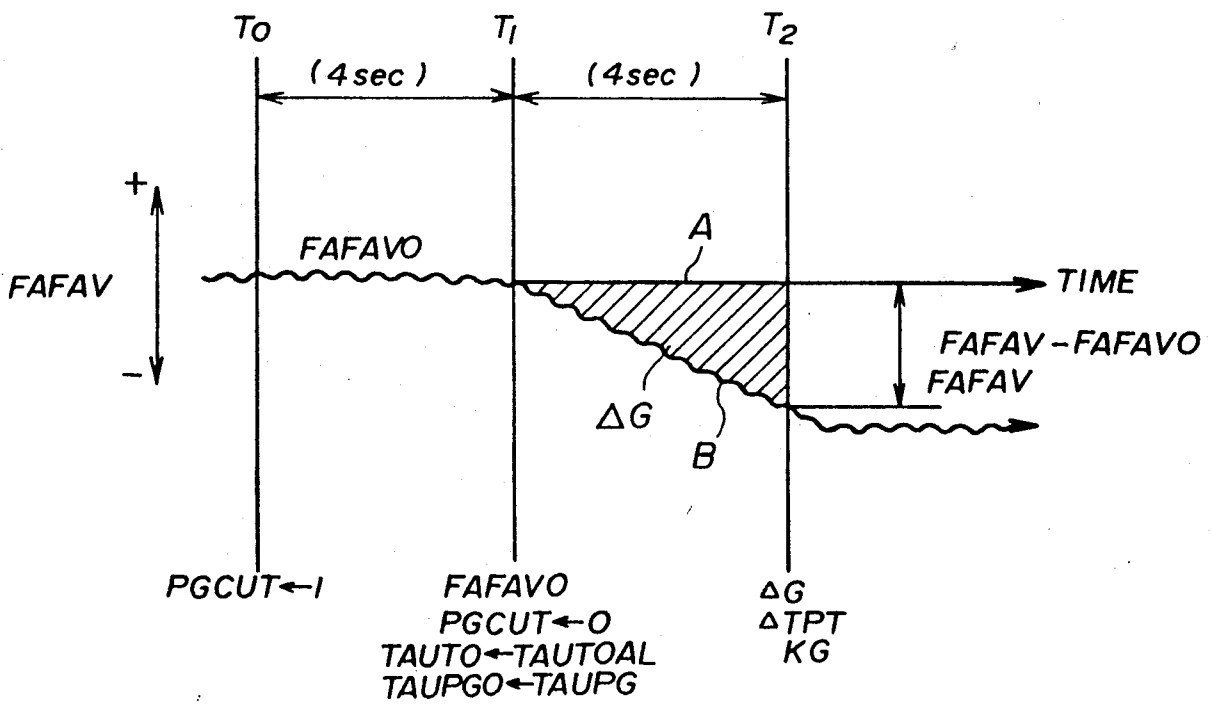
FIG. 27 is a time chart explaining a difference Δ G.

FIG. 27 is a time chart for explaining the equation (4). A time $T_0$ corresponds to the time when the purge cut is executed in the above step 416. FAFAV0 is checked for the elapsing of 4 seconds from $T_0$. A time $T_1$ is the time when 4 seconds have elapsed since $T_0$. The final FAFAV0 is obtained by the execution of the step 420 at $T_1$, and the purge is executed by the execution of the step 428. TAUT0 and TAUPG0 are obtained respectively by the execution of the steps 436 and 438. Further, a time $T_2$ is the time when 4 seconds have elapsed since $T_1$, and the process after the step 442 is executed at this $T_2$.

In the equation (4), FAFAV is the FAFAV at $T_2$, and TATUTOTAL is the amount obtained by integrating the basic amount of fuel injected by the execution of the routine 600 of FIG. 26 at T,. Accordingly, (FAFAV−FAFAV0 represents a difference between FAFAV at $T_1$ and FAFAV at $T_2$, and (TAUTOTAL−TAUT0) represents an amount obtained by integrating the basic injection amount of fuel in the same 4 seconds. (TAUPG−TAUPG0) of the equation (5) represents an amount obtained by integrating the correction amount of the purge for the 4 seconds from $T_1$ to $T_2$.

When the above mentioned routine 400 is executed in the specified standard condition where the atmospheric pressure or fuel composition is the basic value, a correction amount of injected fuel, determined by purging to the intake pipe 41 for the 4 seconds from $T_1$ to $T_2$, is equal to the$\Delta$ TPT of the equation (5). Accordingly, FAFAV is not changed after T', and FAFAV0 remains the same value, as shown by line A of FIG. 27. However, the purge executed from T', usually, increased or decreases (FAFAV is decreased in FIG. 27). This is because a net amount of fuel vapor generated is changed from that generated in the specified standard condition due to changes in atmospheric pressure or fuel composition. Therefore, the correction performed in accordance with the above $\Delta$ TPT is not sufficient, and an air-fuel ratio shifts to rich or lean side. It is to be understood that the increased or decreased amount of injected fuel $\Delta$ G caused by the changing of FAFAV to FAFAV0 corresponds to the difference between a required injection amount under the standard condition and an actual injected amount in an actual condition, that is, to an excess or shortage of the correction amount $\Delta$ TPT.

FAFAV gradually increases or decreases from the time the purge is executed and becomes stable after certain time. In this embodiment, the time needed for FAFAV to become stable is assumed to be approximately 4 seconds. Accordingly, $\Delta$ G is represented by the shaded area of FIG. 27. Since the amount obtained by integrating the basic injection amount from $T_1$ to $T_2$ is (TAUTOTAL−TAUT0), $\Delta$ G is calculated by the equation (4),(FAFAV−FAFAV0)/2×(TAUTOTAL−TAUT0).

As mentioned above, after $\Delta$ G and $\Delta$ TPT are computed in the steps 422 and 424, the routine proceeds to step 446. In the step 446, a correction factor KG for correcting an amount of evaporative fuel gas is computed as per the following equation (6). KG is a factor for correcting a generated amount of evaporative fuel gas under the standard condition to be equal to that under the actual conditions.

$$KG = 1 + (\Delta G / \Delta TPT) \quad (6)$$

An explanation of the equation will be given later.

In the next step 448, the flag PGLRN is set to 1, and the routine ends.

By the execution of the step 448, in the next execution, the routine will proceed to step 450 from the step 430. Those steps after the step 450 are a routine for a learning process of the correction factor KG, which factor is obtained in the step 446. KG is obtained in the execution of the routine after a start of the engine. However in a long operation of the engine, changes occur in the atmospheric pressure or the fuel composition due to a temperature rise of the fuel. Since an amount of generated evaporative fuel gas also changes due to the changes in the atmospheric pressure or the fuel composition, it is required to updated the initially obtained value for KG in accordance with the changes.

First, in step 450, a difference $\Delta$ FAF is obtained, which is a difference between the final FAFAV0 obtained in the step 420 and the FAFAV for the present time obtained by the ECU 20. In the next step 452, it is judged whether or not $\Delta$ FAF is larger than a predetermined value A. IF $\Delta$ FAF is larger than A, the routine proceeds to step 454 where the present KG is revised by being multiplied by 1.02. If $\Delta$ FAF is not larger than the predetermined value A, the routine proceeds to step 456. In the step 456, it is judged whether or not $\Delta$ FAF is smaller than −A. If $\Delta$ FAF is smaller than −A, the routine proceeds to step 458. In the step 458, KG is revised by being multiplied by 0.98. If $\Delta$ FAF is larger than −A than, that is $\Delta$ FAF is between A and −A, the routine ends without revising KG. In this manner, KG is updated by changing it by 2% thereof if the difference between FAFAV and FAFAV0 exceeds the predetermined value A. Therefore, by using the updated KG, an actual amount of evaporative fuel gas can be obtained under always changing conditions.

Figure 28:
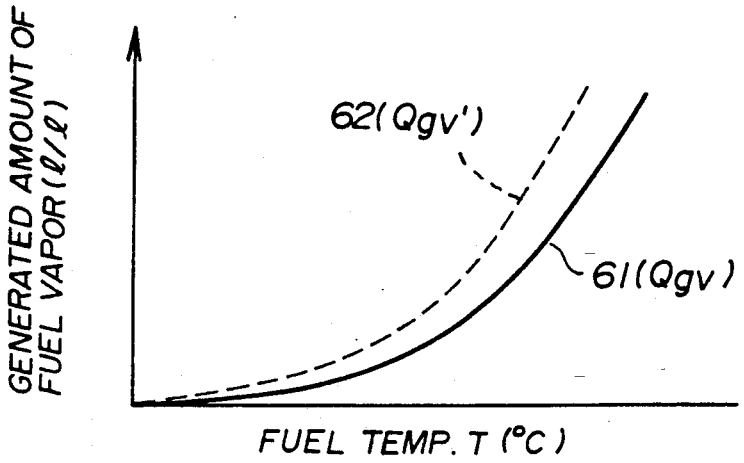
FIG. 28 is a graph showing results of measurements of a generated amount of fuel vapor at various temperatures.

Next, a detailed description will be given of the equation (3) with reference to FIG. 28. FIG. 28 is a graph showing a result of measurement of generated amount of fuel vapor at various temperatures. A solid curved line 61 indicates an amount of fuel vapor Qgv generated under standard conditions. The curve 61 is approximately represented by the following equation (7).

$$Qgv \propto Cg \times \exp(\alpha \cdot T) \quad (7)$$

Where Cg and $\alpha$ are constants, and they do not change unless the atmospheric pressure or fuel composition is changed. Therefore, the curve 61 can be represented by a straight line 61', as shown in FIG. 29, on a single logarithmic scale.

Figure 29:
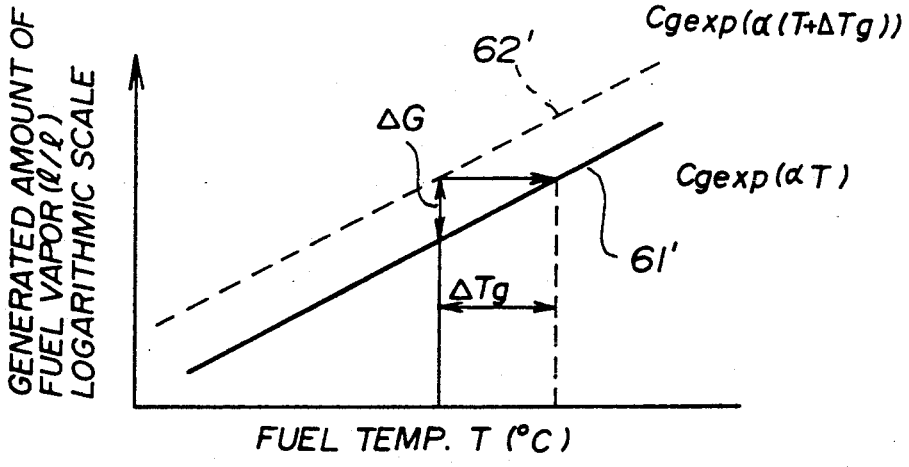
FIG. 29 is a graph of FIG. 28 converted to single logarithmic scale.

The amount of fuel vapor Qgv' generated under the actual conditions can be also represented by a dotted curved line 62 in FIG. 28, and, similarly to the line 61, the curved line 62 can be represented by a straight line 62', as shown in FIG. 29, on a single logarithmic scale. According to an experiment performed by the applicant, the line 62' has the same slope as that of the line 61'. Lines obtained from other conditions are also parallel to the line 61'. Therefore, as shown in FIG. 29, an amount of fuel vapor indicated by a point on the line 62' can be represented by an amount of fuel vapor indicated by a point on the line 61' by simply shifting the fuel temperature by $\Delta$ Tg. This relationship is represented by the following equation (8).

$$\begin{aligned} Qgv' \ \alpha \ & Cg \times \exp(\alpha \cdot (T + \Delta Tg) \\ &= Cg \times \exp(\alpha \cdot Tg) \times \exp(\alpha \cdot T) \\ &= Cg \times KG \times \exp(\alpha \cdot T) \end{aligned} \quad (8)$$

As is apparent from the above mentioned equations (4) and (5), the actual amount of fuel vapor Qgv' can be simply obtained by multiplying KG by Qgv. Therefore, by obtaining KG by measuring the changed FAFAV, the amount of generated fuel vapor under the standard conditions can be corrected to be the amount of fuel vapor under the actual conditions.

Meanwhile, by using the difference $\Delta$ G mentioned above, a relationship between amounts of fuel vapor Qgv and Qgv' generated in 4 seconds is represented by the following equation (9).

$$Qgv' = Qgv + \Delta G \quad (9)$$

Since an air-fuel ratio according to the Qgv generated in the 4 seconds is corrected by $\Delta$ TPT to be the stoichiometric air-fuel ratio, which is explained with the equation (5), Qgv is equal to $\Delta$ TPT, thus the equation (9) can be converted to the equation (10).

$$\Delta TPT' = \Delta TPT + \Delta G \quad (10)$$

Where Δ TPT' is an amount obtained by integrating the correction amount of fuel injected in 4 seconds while a purge is executed under actual conditions.

The equation (11) is obtained from the equation (8).

$$Qgv' = KG \times Qgv \quad (11)$$

The equation (11) is converted to the equation (12) with Δ TPT' and Δ TPT.

$$\Delta TPT' = KG \times \Delta TPT \quad (12)$$

The above mentioned equation (3), $KG = 1 + (\Delta G / \Delta TPT)$ is then obtained from the equations (10) and (12).

Figure 30:
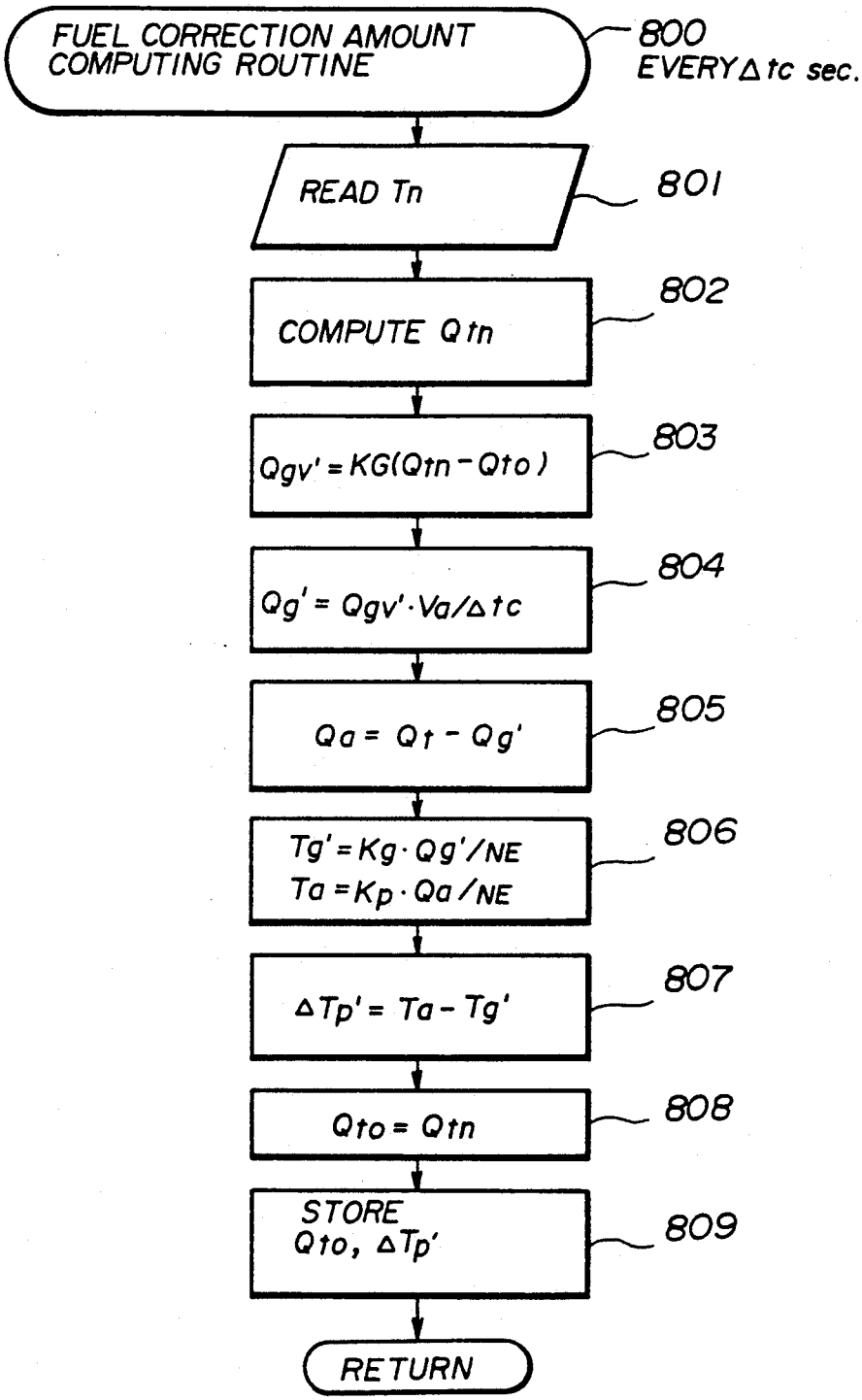
FIG. 30 is a flow chart of a routine 800 for the correction of fuel to be injected from the fuel injection valve.

After the corrected amount of the fuel vapor under actual conditions was computed by the process mentioned above, which corresponds to that performed by the means 6 of FIG. 18 (FIG. 1), a fuel correction amount for fuel to be injected is computed in accordance with a routine 800 shown in FIG. 30.

FIG. 30 is a flow chart of a routine 800 for the correction of a fuel amount to be injected by the fuel injection valve 45. The routine 800 is executed every Δ Tc seconds, similarly to the above mentioned routine 100 of FIG. 5. First, in step 801, the CPU 50 reads the fuel temperature data Tn, which data was received from the temperature sensor 24 and stored in the RAM 52. Next, in step 802, the net amount of the fuel vapor Qtn is computed by interpolation in accordance with a map 61 shown in FIG. 29. The map 61 is a relationship, obtained by experiment, between the fuel temperature T and the integrated amount of generated fuel vapor Qt generated by 1 liter of volume in the fuel tank 23 at the temperatures from −20° C. to T° C.

Next, the amount of fuel vapor Qgv', generated when the fuel temperature is raised from T° to Tn, is obtained in step 803. As shown in FIG. 28, the map 61 for the standard conditions is converted to the map 62 for the actual conditions by multiplying by the factor KG. Qgv' can be computed as a difference between a generated amount of fuel vapor $KG \times Qt_0$ stored the last time the routine was executed and a generated amount of fuel vapor $KG \times Qtn$ of the present time. The Qgv' is calculated as per the equation (13).

$$Qgv' = KG\,(Qtn - Qt_0) \quad (13)$$

Both $Qt_0$ and Qtn respectively represent the generated amount of fuel vapor obtained from the map 61. The amount of fuel vapor Qgv' for the standard conditions can be simply corrected to an actual amount of fuel vapor Qgv' by multiplying by the factor KG. Therefore, only one map stored in the ROM 51 is enough for computing an actual amount of fuel vapor. In other words, the ROM 51 is not required to have an area to store various maps corresponding to various conditions of the atmospheric pressure or fuel composition.

The amount of fuel Qgv' is an integrated amount of fuel vapor generated by 1 liter of volume in the fuel tank 23 at temperatures from $T_0$ to Tn. Accordingly, in the step 804, the amount of fuel vapor Qg' (liters/sec) of the present time is calculated as per the equation $Qgv' \times Va / \Delta tc$.

In step 805, the amount of air Qa contained in the evaporative fuel gas is calculated by subtracting the amount of fuel vapor Qg' from the amount of generated evaporative fuel gas Qt of the routine 100. In step 806, converted values for a fuel injection amount of each injection Tg' and Ta are calculated by respectively multiplying by the factors Kg and Kp and dividing by rotation of the engine NE. The factor Kg is for converting the amount of fuel vapor represented by liters, contained in the evaporative fuel gas purged by the solenoid valve 31, to the amount of fuel to be injected from the fuel injection valve 45 (duration of injection time). The factor Kp is for converting the amount of air, contained in the evaporative fuel gas purged by the solenoid valve 31, to the amount of fuel to be injected by the fuel injection valve 45 (duration of injection time) so as to obtain the stoichiometric air-fuel ratio.

Next, in step 807, a correction value Δ Tp' of the amount of fuel injection is calculated by subtracting Tg' from Ta. If Ta > Tg', that is, Δ Tp' is a positive number, the mixing ratio of fuel vapor and air in the evaporative fuel gas is in the rich side of the stoichiometric air-fuel ratio. If Ta < Tg', that is, Δ Tp is a negative number, the mixing ratio of the amount of fuel vapor and air in the evaporative fuel gas is in lean side from the stoichiometric air-fuel ratio. When the evaporative fuel gas purged from the solenoid valve has the same air-fuel ratio as the stoichiometric air-fuel ratio Ta is equal to Tg', that is Δ Tp' = 0.

In step 808, in preparation for the next execution, $Qt_0$ is substituted by the amount of the generated evaporative fuel Qtn at the present time. In step 809, the revised $Qt_0$ and Δ Tp' obtained in the step 807 are stored in the RAM 52, and the routine 800 ends.

As mentioned above, through the execution of the routine 800, the amount of air Qa in the evaporative fuel gas is computed from the net amount of the fuel vapor and the amount of the evaporative fuel gas; thus the correction valueΔ Tp' for correcting the air-fuel ratio to be the stoichiometric ratio can be obtained.

Figure 31:
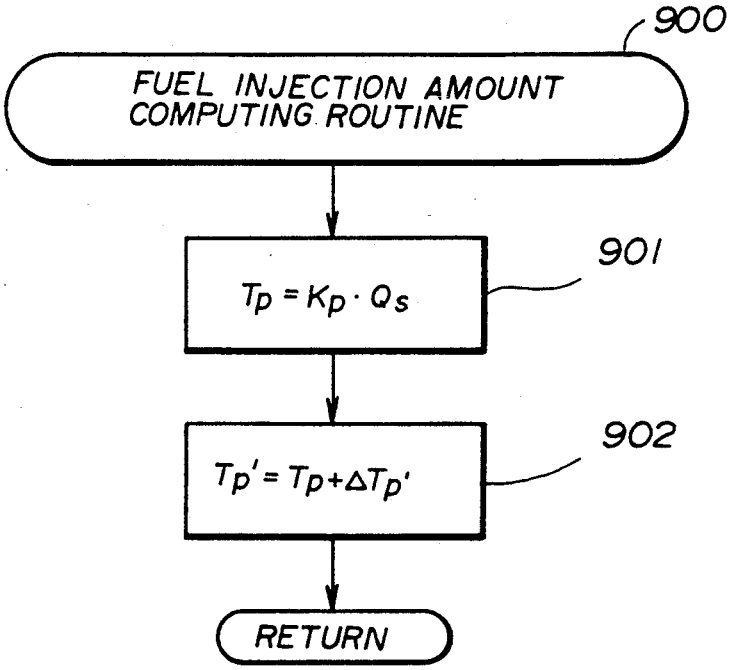
FIG. 31 is a flow chart of a routine 900 for computing the amount of fuel to be injected.

FIG. 31 is a flow chart of a routine 900 for computing the amount of fuel to be injected, which routine is executed by the ECU 20. In step 901, a basic amount of fuel Tp to be injected by the fuel injection valve 45 is calculated by multiplying the factor Kp, used in the step 806 of the routine 800, by the amount of air Qs obtained from the air flow sensor 42. The amount of fuel Tp is equal to an amount of fuel to be injected to the intake pipe 41 when the evaporative fuel gas is not purged, so that the stoichiometric air-fuel ratio for the amount of air Qs is realized.

In step 902 an actual amount of fuel Tp' to be injected by the fuel injection valve 45 is calculated by adding the correction value Δ Tp', which is obtained by the execution of the routine 800, to the basic amount of fuel Tp obtained in the step 901, and the routine 900 ends.

As mentioned above, the air-fuel ratio of the mixture gas suctioned into the engine is corrected, by the correction amount of fuel Tp' to be injected, to be the stoichiometric air-fuel ratio without causing to fluctuate an air-fuel ratio feed-back correction factor FAF. This enables to give preferable effects on drivability, fuel economy, and exhaust emission because the response is faster than in the conventional method that controls a mixture to be the stoichiometric air-fuel ratio by changing a value of FAF. Further, the amount of injected fuel Tp' is appropriately controlled even though the atmospheric pressure or fuel composition vary, and thus an optimum control of the air fuel ratio, Under any conditions of the engine, is realized.

Additionally, according to the embodiment mentioned above, optimum control of the air-fuel ratio prevents the evaporative fuel passes through the canister 30 while the engine is running. This can assist in preventing the canister from deteriorating because the evaporative fuel, generated while the engine is running, contains high boiling point compositions which cause a deterioration of the adsorbent in the canister.

The present invention is not limited to the specifically disclosed embodiments, and variations and modifications may be made without departing from the scope of the present invention.

What is claimed is:

1. An evaporative fuel control system for an internal combustion engine comprises:

an evaporative fuel supplying system comprising a fuel tank, a purge passage connecting an intake line of the engine and the fuel tank;

a volume detecting means, for detecting a volume of space, of said fuel tank, filled with evaporative fuel gas;

temperature detecting means, for detecting a temperature of fuel in said fuel tank;

flow detecting means, for detecting an amount of air suctioned into said intake line and flowing therein;

a net fuel vapor amount computing means, for computing a first target flow amount of evaporative fuel gas to be purged into said intake line in accordance with signals from said volume detecting means, said temperature detecting means, and said flow detecting means, and for computing a fuel vapor amount contained in said first target flow amount;

a fuel correction amount computing means, for computing an air flow amount contained in said first target flow amount of evaporative fuel gas purged into said intake line in accordance with a fuel vapor amount computed by said net fuel vapor amount computing means, and for computing a correction amount of fuel to be injected into said intake line so as to obtain a stoichiometric air-fuel ratio in various conditions of the engine.

2. The evaporative fuel control system as claimed in claim 1, wherein said net fuel vapor amount computing means comprises;

an evaporative fuel gas amount computing means, for computing said first flow amount of evaporative fuel gas based on a relationship between fuel temperature as obtained by said fuel temperature detecting means and a generated amount of evaporative fuel gas; and a fuel vapor amount computing means for computing an amount of fuel vapor contained in said first target flow amount based on a relationship between fuel temperature as obtained by said fuel temperature detecting means and a generated amount of fuel vapor.

3. The evaporative fuel control system as claimed in claim 2, wherein;

said evaporative fuel supplying system further includes a solenoid valve that opens and closes said purge passage so as to control an amount of evaporative fuel gas flowing into said intake system;

a degree of opening of said solenoid valve is controlled so that a flow amount of evaporative fuel gas purged via said solenoid valve, which amount is computed based on a signal from said air flow sensor, is equal to said first target flow amount of evaporative fuel gas.

4. The evaporative fuel control system as claimed in claim 1, wherein said net fuel vapor amount computing means further comprises;

a remaining evaporative fuel gas amount computing means, for computing a remaining amount of evaporative fuel gas in said fuel tank, which amount was not purged at the last purge execution, a purge adjusting amount computing means, for computing a pressure increase caused in said fuel tank by a total pressure of the remaining evaporative fuel gas and the generated evaporative fuel gas, for computing a pressure in said intake line based on a relationship between revolution of the engine and a pressure inside the intake line, for computing an adjusting amount for said first target flow amount based on the pressure difference between said increased pressure and said pressure in said intake line; and wherein said fuel correction amount computing means computing a fuel vapor amount contained in said adjusted first target flow amount.

5. The evaporative fuel control system as claimed in claim 4, wherein;

said evaporative fuel supplying system further includes a solenoid valve that opens and closes said purge passage so as to control an amount of evaporative fuel gas flowing into said intake system;

said purge adjusting amount computing means is for computing, based on said pressure difference, the maximum flow of evaporative fuel gas purged into said intake line via said solenoid valve, for determining a second target flow amount to be said maximum flow when said first target flow amount is greater than said maximum flow, for determining, when said first target flow amount is equal to or less than said maximum flow, said second target flow amount a sum of said first target flow amount and said remaining amount of evaporative fuel gas; and wherein the degree of opening of said solenoid valve is controlled in accordance with said second target flow amount.

6. The evaporative fuel control system as claimed in claim 5, wherein an amount of evaporative fuel gas added to said first target flow amount when said first target flow amount is equal to or less than said maximum flow is a portion of said amount of remaining evaporative fuel gas, which remaining evaporative fuel gas was not purged at the last purge execution, so that the purged amount of evaporative fuel is maintained at a level less than a predetermined amount.

7. The evaporative fuel control system as claimed in claim 6, wherein said amount of evaporative fuel gas added to said first target flow amount is one-eighth thereof.

8. The evaporative fuel control system as claimed in claim 1, wherein;

said evaporative fuel system further comprises air-fuel ratio feed-back control means, for computing a first correction factor for correcting a fuel amount to be injected so that an air-fuel ratio for the engine is controlled to be at a stoichiometric air-fuel ratio;

said net fuel vapor amount computing means further comprises:

a deviation amount computing means, for computing a deviation amount of an actually injected fuel amount, which actually injected fuel amount was corrected by said first correction factor, deviating from a required injection fuel amount, which is an amount obtained while a purge of evaporative fuel gas is not executed under a predetermined standard condition, a correction amount computing means for computing a first correction amount for fuel to be injected, which amount is for the condition where a purge of evaporative fuel gas is executed under said standard condition, so as to obtain a stoichiometric air-fuel ratio, a correction factor computing means for computing a second correction factor for correcting a relationship between fuel temperature and an amount of generated fuel vapor in accordance with said deviation amount and said first correction amount, said net fuel vapor amount computing means computing a net amount of fuel vapor purged into said intake line in accordance with said second correction factor.

9. The evaporative fuel control system as claimed in claim 8, wherein said deviation amount computing means starts to compute said deviation amount when a first predetermined time has elapsed after a purge of evaporative fuel gas from said evaporative fuel supplying system is stopped so as to compute said deviation amount in a stable condition of the engine.

10. The evaporative fuel control system as claimed in claim 9, wherein said first predetermined time is four seconds.

11. The evaporative fuel control system as claimed in claim 8, wherein said deviation amount computing means computes said deviation amount based on a difference between said first correction factor computed at the starting time of the urge, and said first correction factor computed after a second predetermined time has elapsed, when said first correction factor has become stable.

12. The evaporative fuel control system as claimed in claim 11, wherein said second predetermined time is four seconds.

* * * * *

UNITED STATES PATENT AND TRADEMARK OFFICE

CERTIFICATE OF CORRECTION

PATENT NO. : 5,237,979

DATED : August 24, 1993

INVENTOR(S) : Yoshihiko Hyodo, et al.

It is certified that error appears in the above-indentified patent and that said Letters Patent is hereby corrected as shown below:

| Column | Line | |
|---|---|---|
| 3 | 3 | Change "litter" to --liter--. |
| 4 | 29 | Change "passage2" to --passage 2--. |
| 5 | 11 | Change "controling" to --controlling--. |
| 5 | 34 | Change "Through" to --Although--. |
| 5 | 37 | Change "fort" to --for--. |
| 6 | 62 | Change "everyΔ" to --every Δ--. |
| 7 | 33 | Change "T°" to --$T_o$--. |
| 8 | 6 | Change "degreeα" to --degree α--. |
| 8 | 44 | Change "raised" to --rises--. |
| 9 | 5 | After "that is" insert --,--. |
| 9 | 8 | After "that is" insert --,--. |
| 9 | 40 | Change "litter" to --liter--. |
| 10 | 3 | Change "allow" to --allows--. |
| 10 | 51 | Change "purqed" to --purged--. |
| 11 | 15 | Change "Outlet" to --outlet--. |
| 11 | 56 | Change "VaΔQ" to --Va+ΔQ--. |
| 12 | 13 | Change "differenceΔ Pm" to --difference Δ Pm--. |

UNITED STATES PATENT AND TRADEMARK OFFICE

CERTIFICATE OF CORRECTION

PATENT NO. : 5,237,979

DATED : August 24, 1993

INVENTOR(S) : Yoshihiko Hyodo, et al.

It is certified that error appears in the above-indentified patent and that said Letters Patent is hereby corrected as shown below:

| Column | Line | |
|---|---|---|
| 12 | 14 | Change "Outlet" to --outlet--. |
| 12 | 20 | Change Ptank Patm" to --Ptank-Patm--. |
| 12 | 24 | Change Ptank Patm" to --Ptank-Patm--. |
| 12 | 37 | Change "difference$\Delta$ Pm" to --difference $\Delta$ Pm--. |
| 12 | 46 | Change "Qt Qmax" to --Qt-Qmax--. |
| 13 | 40 | Change "Of" to --of--. |
| 15 | 15 | Change "an" to --a--; change "whole" to --all of the--. |
| 15 | 60 | Change "with$\Delta$" to --with $\Delta$--. |
| 15 | 64 | Change "equals" to --is equal--. |
| 16 | 13 | After "amount" delete "of". |
| 16 | 42 | Before "circulated" insert --be--. |
| 16 | 50 | After "corresponding" insert --to--. |
| 18 | 12 | After "description" insert --will be given of a process for correction--. |

UNITED STATES PATENT AND TRADEMARK OFFICE

CERTIFICATE OF CORRECTION

PATENT NO. : 5,237,979

DATED : August 24, 1993

INVENTOR(S) : Yoshihiko Hyodo, et al.

It is certified that error appears in the above-indentified patent and that said Letters Patent is hereby corrected as shown below:

| Column | Line | |
|---|---|---|
| 18 | 13 | Delete "for correction of a generated amount of evapo-". |
| 18 | 14 | Delete "rative fuel". |
| 18 | 15 | Change "1-8" to --1-3--. |
| 18 | 25 | Change "Delete "408," (second occurrence). |
| 18 | 32 | Change "in less" to --is less--. |
| 20 | 27 | Change "judqed" to --judged--. |
| 20 | 36-37 | Change "$^{A}$G=..." to --$\Delta$G=...--. |
| 21 | 7 | Change "T'" to --$T_1$--. |
| 21 | 9 | Change "T'" to --$T_1$--. |
| 21 | 25 | Before "certain" insert --a--. |
| 21 | 58 | Change "updated" to --update--. |
| 22 | 5 | Change "-A than," to -- -A,--. |
| 23 | 35 | Change "T°" to --$T_o$--. |
| 24 | 22 | After "ratio" insert --,--. |
| 24 | 55 | Change "to fluctuate" to --fluctuation of--. |
| 24 | 57 | Change "enables to give" to --produces--. |

UNITED STATES PATENT AND TRADEMARK OFFICE

CERTIFICATE OF CORRECTION

PATENT NO. : 5,237,979

DATED : August 24, 1993

INVENTOR(S) : Yoshihiko Hyodo, et al.

It is certified that error appears in the above-indentified patent and that said Letters Patent is hereby corrected as shown below:

| Column | Line | |
|---|---|---|
| 24 | 68 | Change "passes" to --from passing--. |
| 28 | 14 | Change "urge" to --purge--. |

Signed and Sealed this

Seventh Day of June, 1994

*Attest:*

*Attesting Officer*

BRUCE LEHMAN

*Commissioner of Patents and Trademarks*